US008172379B2

(12) United States Patent
Hagiwara

(10) Patent No.: US 8,172,379 B2
(45) Date of Patent: May 8, 2012

(54) LIQUID EJECTING HEAD UNIT AND METHOD OF MANUFACTURING THE SAME

(75) Inventor: Hiroyuki Hagiwara, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 372 days.

(21) Appl. No.: 12/473,168

(22) Filed: May 27, 2009

(65) Prior Publication Data

US 2009/0295882 A1 Dec. 3, 2009

(30) Foreign Application Priority Data

May 27, 2008 (JP) ..... 2008-138773
Mar. 19, 2009 (JP) ..... 2009-069019

(51) Int. Cl.
*B41J 2/175* (2006.01)

(52) U.S. Cl. ..... 347/85; 347/84

(58) Field of Classification Search ..... None
See application file for complete search history.

(56) References Cited

U.S. PATENT DOCUMENTS 7,387,376 B2 * 6/2008 Murakami et al. ..... 347/84

FOREIGN PATENT DOCUMENTS

| | | | |
|---|---|---|---|
| JP | 05-057965 A | | 3/1993 |
| JP | 2000-025207 A | | 1/2000 |
| JP | 2003-088778 A | | 3/2003 |
| JP | 2003-237100 A | | 8/2003 |
| JP | 2003237100 A | * | 8/2003 |
| JP | 2005-262521 A | | 9/2005 |

* cited by examiner

*Primary Examiner* — Matthew Luu
*Assistant Examiner* — Erica Lin
(74) *Attorney, Agent, or Firm* — Kilpatrick Townsend & Stockton LLP

(57) ABSTRACT

A liquid ejecting head unit is provided with a plurality of liquid ejecting heads which each have a nozzle row in which a plurality of nozzle openings are arranged and a liquid passage port to which an inner flow passage opens and an outer flow passage is connected. The liquid ejecting head unit includes: first flow passage members which are each provided with a first flow passage supplying a liquid to the liquid passage port of each of the plurality of liquid ejecting heads; second flow passage members which are each provided with a second flow passage supplying the liquid to the first flow passage; and a switching member which is provided between the first and second flow passages and allows the plurality of first flow passages to communicate with the plurality of second flow passages in a predetermined communication relation.

5 Claims, 13 Drawing Sheets

LIQUID EJECTING HEAD UNIT AND METHOD OF MANUFACTURING THE SAME

BACKGROUND

1. Technical Field

The present invention relates to a liquid ejecting head unit provided with a plurality of liquid ejecting heads capable of ejecting a liquid from nozzle openings and a method of manufacturing the same.

2. Related Art

A liquid ejecting apparatus of which a representative example is an ink jet printing apparatus such as an ink jet printer or a plotter includes a liquid ejecting head unit (hereinafter, also referred to as a head unit) provided with liquid ejecting heads capable of ejecting a liquid such as ink stored in a cartridge or a tank in the form of liquid droplets.

The plurality of liquid ejecting heads are placed on a platform as a common supporting member so as to be arranged in line. In addition, the plurality of liquid ejecting heads are continuously arranged in an arrangement direction of nozzle rows in which nozzle openings of each of the liquid ejecting heads are arranged (for example, JP-A-5-57965 and JP-A-2000-25207).

Here, in the liquid ejecting head unit including the plurality of liquid ejecting heads, liquid ejecting methods such as a method of allowing the plurality of liquid ejecting heads to eject different kinds of liquids or a method of allowing the plurality of liquid ejecting heads to eject a common liquid are required to be individually selected depending on uses of the liquid ejecting apparatus mounted with the liquid ejecting head unit.

In order to change the liquids ejected by the plurality of liquid ejecting heads, a liquid storage unit storing the liquids supplied to the liquid ejecting heads may be changed. However, since the change in the liquid storage unit are accompanied with specification change in the size, the number, arrangement, or the like of the liquid storage unit of the liquid ejecting apparatus, problems with complication and high cost may be caused.

In particular, in the liquid ejecting apparatus including a large liquid ejecting head unit, the specification change in the liquid storage unit is complicated. Therefore, it is necessary to provide a switching member capable of changing flow passages in a simple manner and at low cost.

There was suggested a printing apparatus which has a connection switching member, which is capable of changing a connection relation between a plurality of ink tanks and a plurality of nozzle rows, in an ink supply unit between the nozzle rows and the ink tanks storing ink formed in an ink jet print head (for example, see JP-A-2003-237100).

In the configuration of the printing apparatus disclosed in JP-A-2003-237100, however, a plurality of nozzle rows are just provided in one ink jet print head, no stem flow passage commonly formed in the plurality of ink jet print heads is provided, and no switching member capable of changing the flow of a liquid flowing in a branch flow passage connecting a stem flow passage to the ink jet print head is provided. When the plurality of ink jet print heads and a stem flow passage common to the plurality of ink jet print heads are provided, the size of the head unit becomes large. Therefore, problems occur in that the replacement or modification of the stem flow passage may particularly be complicated and specification modification of the storage unit may be also complicated.

Moreover, theses problems occur not only in the ink jet print head unit having the ink jet print head ejecting ink, but also in a liquid ejecting head unit having a liquid ejecting head ejecting a liquid other than ink.

SUMMARY

An advantage of some aspects of the invention is that it provides a liquid ejecting head unit capable of changing kinds of liquids ejected from liquid ejecting heads with ease and reducing cost, and a method of manufacturing the liquid ejecting head unit.

According to an aspect of the invention, there is provided a liquid ejecting head unit provided with a plurality of liquid ejecting heads which each have a nozzle row in which a plurality of nozzle openings are arranged and a liquid passage port to which an inner flow passage opens and an outer flow passage is connected. The liquid ejecting head unit includes: first flow passage members which are each provided with a first flow passage supplying a liquid to the liquid passage port of each of the plurality of liquid ejecting heads; second flow passage members which are each provided with a second flow passage supplying the liquid to the first flow passage; and a switching member which is provided between the first and second flow passages and allows the plurality of first flow passages to communicate with the plurality of second flow passages in a predetermined communication relation.

According to this aspect of the invention, since the switching member makes it possible to facilitate the change in the kinds of liquids flowing in the first flow passages individually communicating with the liquid ejecting heads and it is not necessary to make specification change of the storage unit, it is possible to reduce cost.

In the liquid ejecting head unit, the switching member may have a shape corresponding to the communication relation and the communication between the plurality of first flow passages and the plurality of second flow passages may be changed by replacing the switching member by a switching member having a different shape. With such a configuration, by replacing the switching member, it is possible to easily change the kinds of liquid flowing in the first flow passages. Moreover, since common constituent elements other than the switching member can be used in the plurality of liquid ejecting heads, it possible to reduce manufacturing cost.

In the liquid ejecting head unit, the switching member may have valves which open by connecting the first flow passage members in portions thereof to which the first flow passage members are connected. With such a configuration, even when the first flow passage members are separated from the switching member in replacement of the switching member, leakage of the liquid inside the switching member to the outside can be reduced by the valves. Accordingly, it is possible to prevent an electric failure or an ejection failure of the liquid ejecting heads from occurring.

In the liquid ejecting head unit, the switching member may have valves which open by connecting the second flow passage members in portions thereof to which the second flow passage members are connected. With such a configuration, even when the second flow passage members are separated from the switching member in replacement of the switching member, leakage of the liquid inside the switching member to the outside can be reduced by the valves. Accordingly, it is possible to prevent an electric failure or an ejection failure of the liquid ejecting heads from occurring.

In the liquid ejecting head unit, the liquid ejecting head may have a connection portion which is connected to an electric wiring and located above the nozzle openings in a vertical direction and the switching member may be located above the nozzle openings in the vertical direction and below the connection portion in the vertical direction. With such a configuration, even when the liquid inside the switching member or the liquid inside of the first and second flow passages leaks to the outside in replacement of the switching member, the liquid can be prevented from being attached to the liquid ejecting heads. Moreover, by allowing the switching member to be located above the nozzle openings in the vertical direction, it is possible to prevent bubbles from penetrating from the nozzle openings to the inside of the liquid ejecting heads even when the first flow passages are separated from the switching member.

According to another aspect of the invention, there is provided a method of manufacturing a liquid ejecting head unit provided with a plurality of liquid ejecting heads which each have a nozzle row in which a plurality of nozzle openings are arranged, a plurality of liquid passage ports to which an inner flow passage opens and an outer flow passage is connected, first flow passage members which are each provided with a first flow passage supplying a liquid to the liquid passage ports of each of the plurality of liquid ejecting heads, and second flow passage members which are each provided with a second flow passage supplying the liquid to the first flow passage. The method includes: selecting one of a plurality of switching members of which communication relations between the first flow passages and the second flow passages are different from each other, on the basis of kinds of liquids ejected from the nozzle rows of the liquid ejecting heads; and allowing the first flow passages to communicate with the second flow passages in a predetermined communication relation by connecting the first and second flow passage members to the selected switching member.

According to this aspect of the invention, since the switching member makes it possible to facilitate the change in the kinds of liquids flowing in the first flow passages individually communicating with the liquid ejecting heads and it is not necessary to make specification change of the storage unit, it is possible to reduce cost. Moreover, since common constituent elements other than the switching member can be used in the plurality of liquid ejecting heads, it possible to reduce manufacturing cost.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described in detail.

First Embodiment

Figure 1:
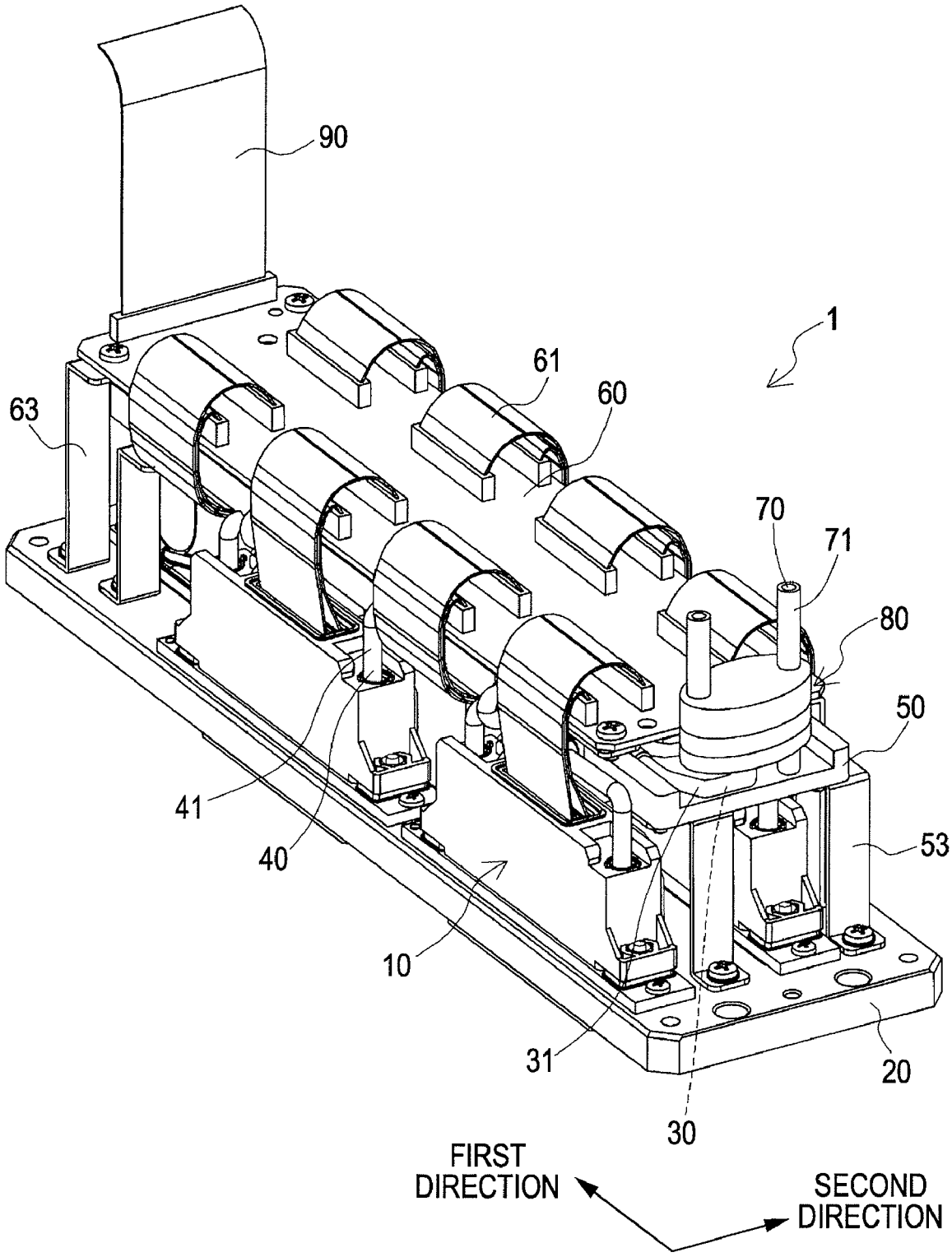
FIG. 1 is a schematic perspective view illustrating a head unit according to a first embodiment of the invention.

FIG. 1 is a schematic perspective view illustrating an ink jet print head unit as an example of a liquid ejecting head unit according to a first embodiment of the invention.

As shown in FIG. 1, an ink jet print head unit 1 (hereinafter, also referred to as a head unit) according to this embodiment includes a platform 20 on which a plurality of ink jet print heads 10 (hereinafter, also referred to as a head) are placed, a plurality of stem flow passages 30, a stem circuit board 60, connection flow passages 70 as a second flow passage, and a switching member 80 which is provided between the stem flow passages 30 and the connection flow passages 70 and selectively switches between the stem flow passages 30 and the connection flow passages 70.

Figure 2:
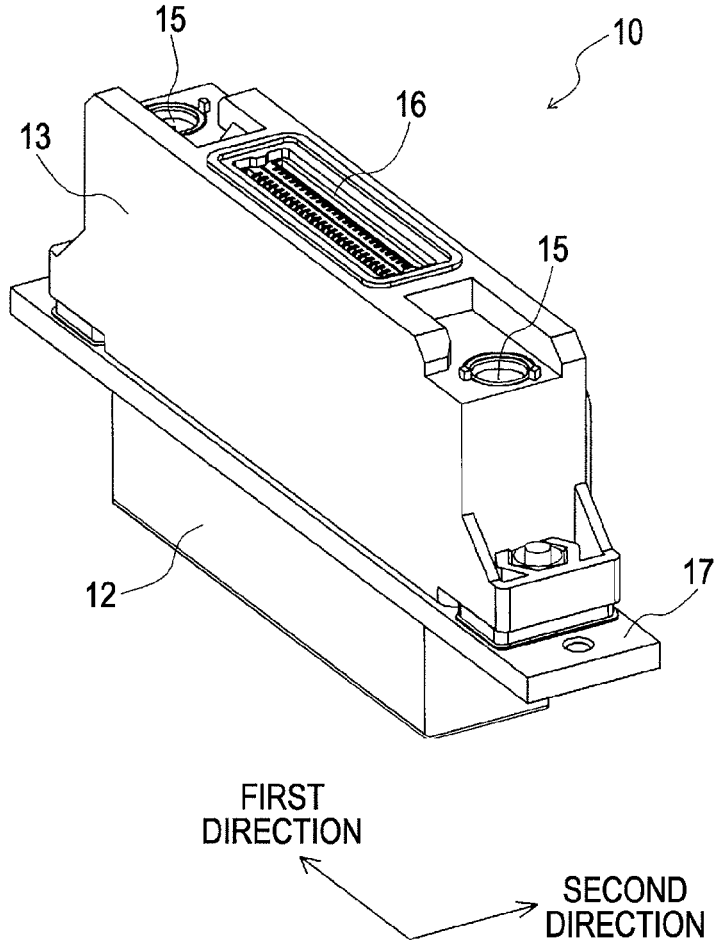
FIG. 2 is a schematic perspective view illustrating a print head according to the first embodiment of the invention.
Figure 3:
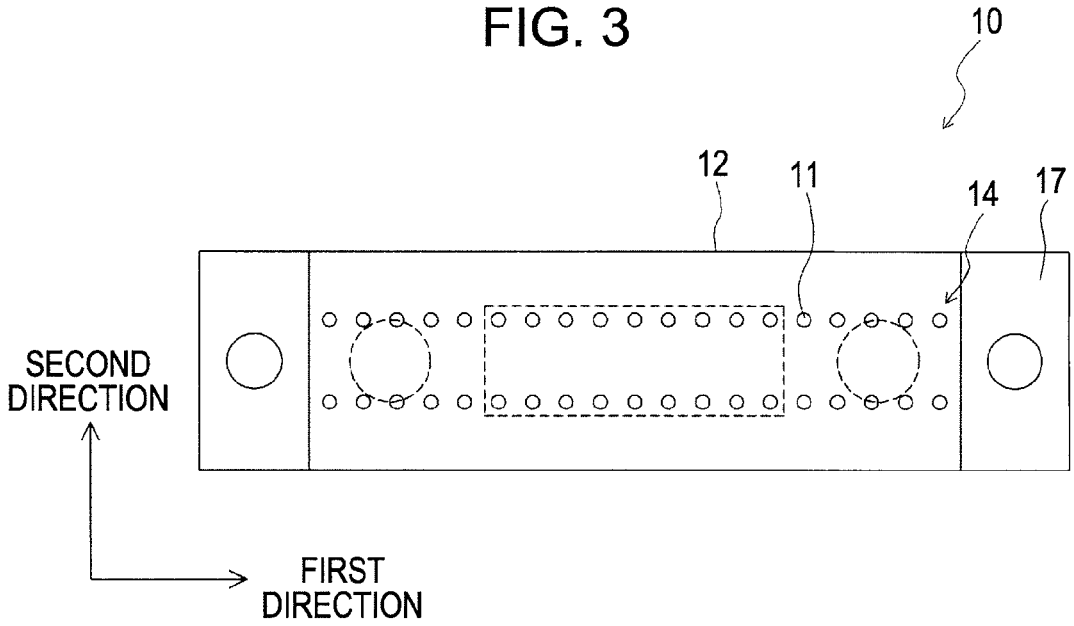
FIG. 3 is a diagram illustrating the bottom surface of the print head according to the first embodiment of the invention.

Here, the ink jet print heads 10 which is an example of a liquid ejecting head according to this embodiment will be described in detail. FIG. 2 is a schematic perspective view illustrating the ink jet print head which is an example of the liquid ejecting head according to the first embodiment of the invention. FIG. 3 is a diagram illustrating the bottom surface of the ink jet print head on side of nozzle openings.

As shown in FIGS. 2 and 3, the ink jet print head 10 (hereinafter, also referred to as a head) according to this embodiment includes a head main body 12 provided with nozzle openings 11 on one end surface thereof and a flow passage member 13 fixed on a surface opposite to the nozzle openings 11 of the head main body 12.

The head main body 12 includes nozzle rows 14 in which the nozzle openings 11 are arranged in line. The number of nozzle rows 14 is not particularly limited. For example, one nozzle row may be formed or two or more nozzle rows, that is, a plurality of nozzle rows may be formed. In this embodiment, two nozzle rows 14 are formed in one head main body 12. In this embodiment, a direction in which the nozzle openings 11 are arranged in line in the nozzle row 14 is referred to as a first direction and a direction intersecting the first direction is referred to as a second direction. Accordingly, the two nozzle rows 14 are arranged in the second direction.

Even though not shown, a pressure generating chamber forming a part of a flow passage communicating with the nozzle opening 11 and a pressure generating member ejecting ink from the nozzle opening by causing variation in pressure in the pressure generating chamber are provided inside the head main body 12.

The pressure generating member is not particularly limited. For example, there are used a pressure generating member which uses a piezoelectric element formed by interposing a piezoelectric material having an electro-mechanical transduction function between two electrodes, a pressure generating member which has a heating element disposed inside a pressure generating chamber and ejects liquid droplets from the nozzle openings 11 by bubbles generated due to heating of the heating element, or a pressure generating member which generates static electricity between a vibration plate and an electrode to deform the vibration plate by an electrostatic force and eject liquid droplets from the nozzle openings 11. As the piezoelectric element, a bending vibration type piezoelectric element which makes bending deformation by laminating a lower electrode, a piezoelectric material, and an upper electrode from a side of the pressure generating chamber and a longitudinal vibration type piezoelectric element which expands and contracts in an axial direction by alternately laminating a piezoelectric material and an electrode forming material, for example, can be used.

The flow passage member 13 which is fixed on a surface opposite to the nozzle openings 11 of the head main body 12 supplies ink from the outside to the head main body 12 or discharges ink from the head main body 12 to the outside.

Liquid passage ports 15 to which an inner flow passage opens and an outer passage is connected and a connector 16 to which an electric signal such as a print signal supplied from the outside are formed in an surface opposite to the surface to which the head main body 12 of the flow passage member 13 is fixed.

In this embodiment, two liquid passage ports 15 are provided. The two liquid passage ports 15 and the connector 16 are arranged in the first direction as an arrangement direction of the nozzle openings 11 in the nozzle rows 14. That is, in this embodiment, the connector 16 is formed in the middle (the middle of the head 10) of the nozzle row 14. By providing one liquid passage port 15 in each of both sides of the connector 16, the total two liquid passage ports 15 are formed. Accordingly, the two liquid passage ports 15 and the connector 16 are arranged inside the length of the nozzle rows 14, that is, the liquid passage ports 15 and the connector 16 overlap with the nozzle rows 14 in plan view (in plan view from the nozzle rows 14 or the liquid passage ports 15).

At least one of the two liquid passage ports 15 formed in the flow passage member 13 functions as a liquid supply port for supplying a liquid from the outside to an inner passage of the head 10. That is, one liquid passage port 15 of the two liquid passage ports 15 functions as the liquid supply port and the other liquid passage port 15 thereof functions as a liquid discharge port for discharging the liquid inside the head 10 to the outside. Alternatively, all the two liquid passage ports 15 may function as the liquid supply port. For example, when the two liquid passage ports 15 all function as the liquid supply port, the inner passages of the head 10 may be configured such that the two liquid passage ports 15 individually communicate with the nozzle rows 14. Alternatively, when the two liquid passage ports 15 function as the liquid supply port and the liquid discharge port, respectively, the inner passages of the head 10 may be configured such that the liquid passage port 15 functioning as the liquid supply port supplies a liquid to both the two nozzle rows 14 and the liquid passage port 15 functioning as the liquid discharge port discharges a liquid from both the two nozzle rows 14.

Of course, the invention is not limited to the number of liquid passage ports 15 or the number of nozzle rows 14 described above. Moreover, the invention is not limited to the configuration in which the liquid passage ports 15 function as the liquid supply port or the liquid discharge port.

A flange 17 protruding outward is formed on the both surface in the first direction of the head 10. The flange 17 is fixed to the platform 20.

Such a head 10 is mounted on the platform 20 of the ink jet print head unit 1 (hereinafter, also referred to as a head unit).

Figure 4:
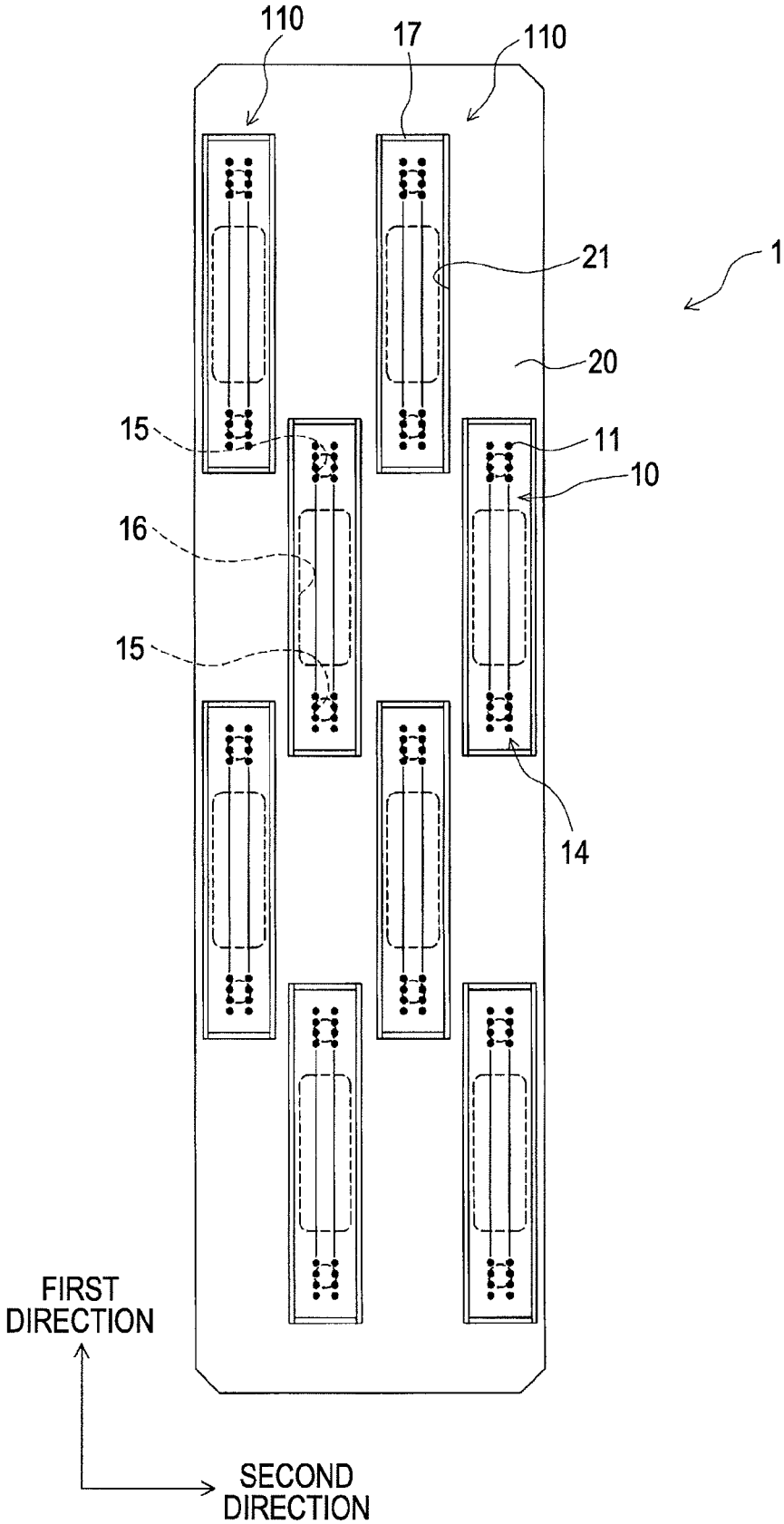
FIG. 4 is a diagram illustrating the bottom surface of the head unit according to the first embodiment of the invention.

Now, the platform 20 will be described in detail. FIG. 4 is a diagram illustrating the bottom surface on a side of the nozzle openings of the ink jet print head unit according to the first embodiment of the invention.

As shown in FIG. 4, the platform 20 which is formed of a plate-shaped member made of metal or resin has holding holes 21 into which the nozzle rows 14 of each head 10 are inserted. Each of the holding holes 21 of the platform 20 is formed of an opening which is slightly larger than the outer circumference of the nozzle rows 14 of the head 10 and smaller than the flange 17. As shown in FIG. 1, the head 10 is held in the platform 20 by fixing the flange 17 onto the circumference of the holding hole 21 with the side of the nozzle rows 14 inserted into the inside of the holding hole 21. The head 10 is provided so as to be slightly movable in the first and second directions with respect to the platform 20 due to a gap between the head 10 and the holding hole 21. The plurality of heads 10 are held in the platform 20 with the nozzle rows 14 each positioned.

A head group 110 is configured such that four heads 10 are arranged in the first direction as the arrangement direction of the nozzle openings 11 in the nozzle rows 14 of the head 10. Two head group 110 are arranged in the second direction. That is, the plurality of heads 10 are arranged in the first and second directions.

Specifically, in each of the heads 10, the nozzle openings 11 form each of the nozzle rows 14 in the first direction. Moreover, the plurality of heads 10 are arranged in a zigzag shape in the first direction. The two head groups 110 constituted by the plurality of heads 10 arranged so that the nozzle rows 14 are continuously formed in the first direction are arranged in the second direction intersecting the first direction.

Here, by continuously arranging the nozzle rows 14 of the plurality of heads 10 in the first direction in each of the head groups 110, printing can be performed widely at a high speed, compared to a case where printing is performed by use of the nozzle rows 14 of just one head 10.

The fact of continuously arranging the nozzle rows 14 of each head group 110 in the first direction means that in the heads 10 of each head group 110 adjacent to each other in the second direction, the nozzle openings 11 in the ends of the nozzle rows 14 of one head 10 are arranged in the first direction in the same positions as those of the nozzle openings 11 in the ends of the nozzle rows 14 of the other head 10.

In this embodiment, as described above, since the two head groups 110 each having four heads 10 arranged in a zigzag shape in the first direction are arranged in the second direction, four groups each constituted by the nozzle rows 14 continuously arranged in the first direction are formed in the head unit 1.

As shown in FIG. 4, by arranging the heads 10 of each head group 110 in the above-described zigzag shape, the liquid passage ports 15 and the connector 16 of each of the heads 10 constituting each head group 110 are arranged so as to be located at a different position in the first direction in the heads 10 adjacent to each other in the second direction. That is, in each head group 110, the heads 10 adjacent to each other in the second direction are arranged such that the position at which the liquid passage ports 15 and the connector 16 of one of the heads 10 are arranged is different in the first direction from the position at which the liquid passage ports 15 and the connector 16 of the other of the heads 10 are arranged. As described above, the liquid passage ports 15 and the connector 16 of each head 10 according to this embodiment are provided within the length of the nozzle rows 14. Therefore, by arranging the heads 10 adjacent to each other in the second direction such that the nozzle openings 11 in the ends of the nozzle rows 14 are located at the same position in the first direction, the position at which the liquid passage ports 15 and the connector 16 of one head 10 of the heads 10 adjacent to each other is different in the first direction from the position at which the liquid passage ports 15 and the connector 16 of the other head 10 are arranged. That is, the liquid passage ports 15 and the connector 16 of the respective heads 10 are positioned such that the liquid passage ports 15 and the connector 16 of each of the heads 10 adjacent to each other in the second direction are located at the different position in the first direction for the nozzle rows 14 which are a reference of positioning of the plurality of heads 10.

Figure 5:
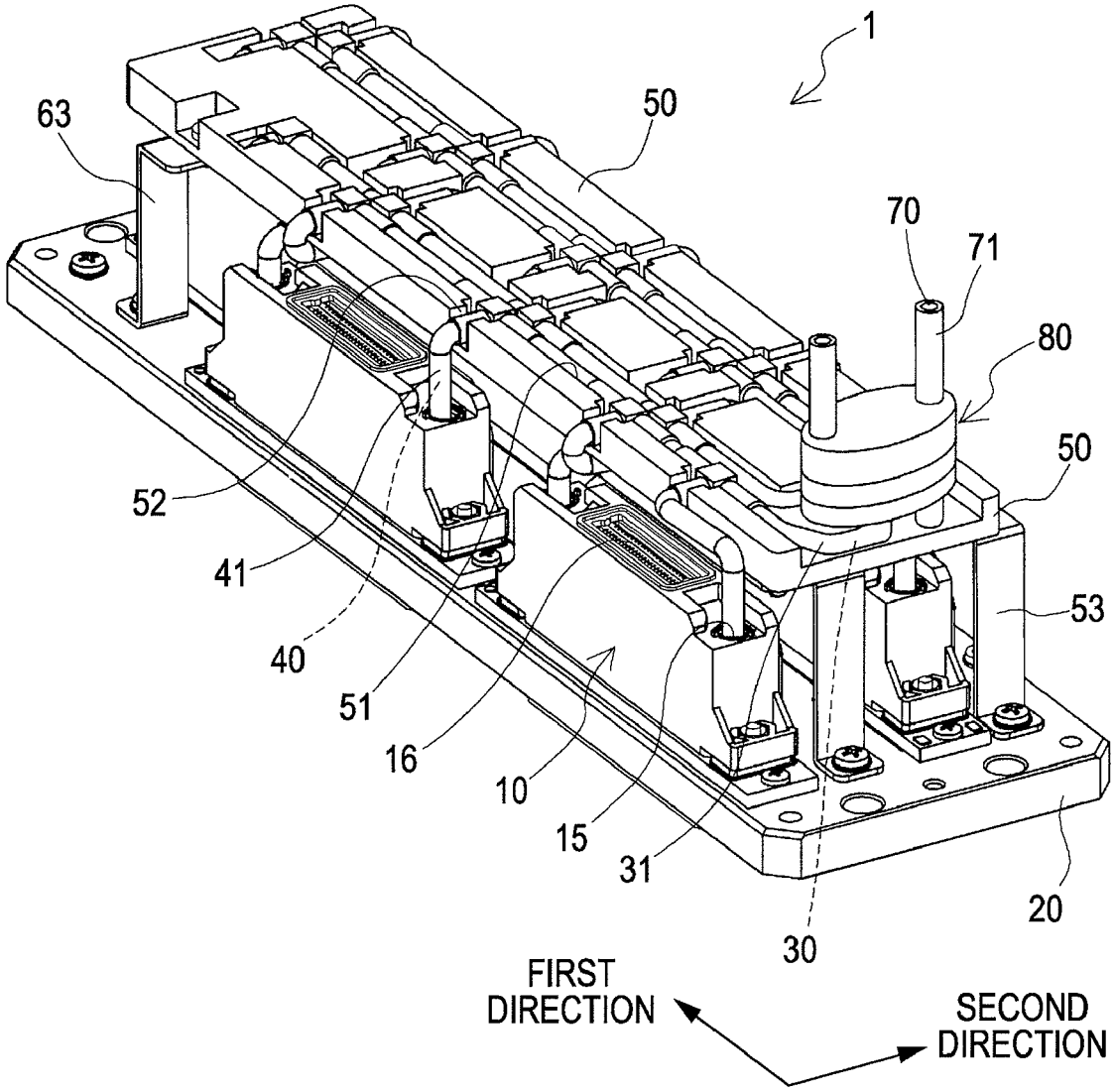
FIG. 5 is a schematic perspective view illustrating main constituent elements of the head unit according to the first embodiment of the invention.
Figure 6:
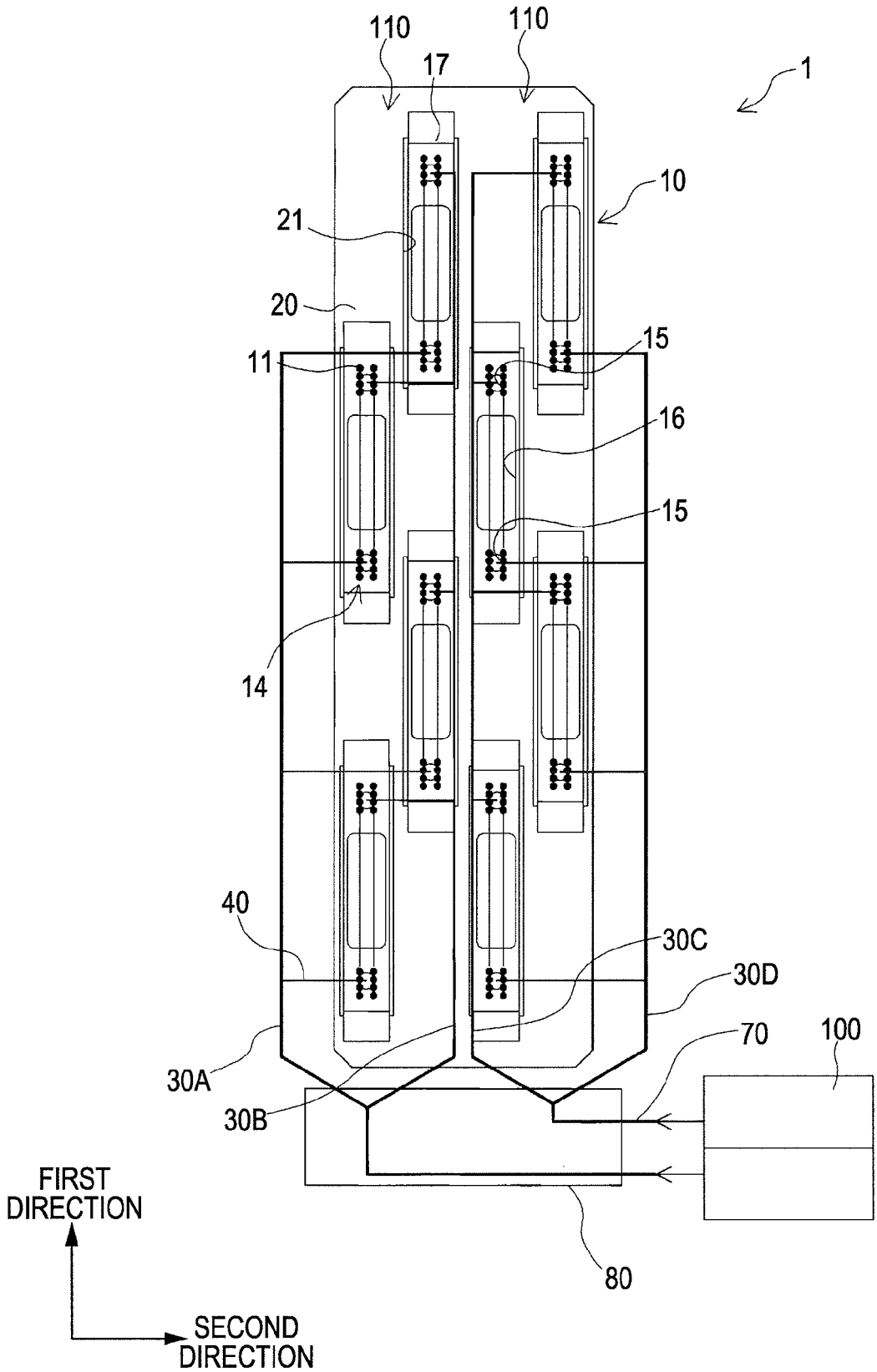
FIG. 6 is a schematic plan view illustrating a connection state of flow passages according to the first embodiment of the invention.

The head unit 1 is also provided with stem flow passage members 31 each having the stem flow passages 30. Now, the stem flow passage member 31 will be described in detail. FIG. 5 is a schematic perspective view illustrating the ink jet print head, some constituent elements of which being removed. FIG. 6 is a schematic plan view illustrating the connection state of the connection flow passages and the stem flow passages.

As shown in FIG. 5, the stem flow passage member 31 having a common stem flow passage 30 is continuously formed in the first direction above the heads 10 placed in the platform 20, that is, above a side opposite to the platform 20 close to the nozzle rows 14. The stem flow passages 30 are connected to the liquid passage ports 15 of the plurality of heads 10 through branch flow passage members 41 each having branch flow passages 40 which are separately provided.

Specifically, the stem flow passage member 31 which is formed of a tube-shaped member made of metal, resin, or the like has the stem flow passages 30 therein. The stem flow passage member 31 is continuously formed in the first direction so as to face the plurality of heads 10. In this embodiment, four stem flow passage members 31 are arranged in the second direction. The stem flow passages 30 of two stem flow passage members 31 among the four stem flow passage members 31 are connected to each of the head groups 110. The switching member 80 described in detail below is detachably provided on one side of the stem flow passage members 31 in the first direction.

The branch flow passage member 41 formed of a flexible tube made of rubber or resin has the branch flow passages 40 therein. By connecting one end of the branch flow passage member 41 to the stem flow passage member 31 and connecting the other end of the branch flow passage member 41 to the liquid passage ports 15 of the head 10, the stem flow passage 30 communicates with the liquid flow passage ports 15 by the branch flow passages 40.

Each of the branch flow passage members 41 is provided in each of the liquid passage ports 15. In this embodiment, since eight heads 10 each having two liquid flow passage ports 15 are placed on the platform 20, the total sixteen branch flow passage members 41 (the branch flow passages 40) are provided. In addition, eight branch flow passage members 41 are connected to one stem flow passage member 31. In this embodiment, by using the branch flow passage members 41 formed of a flexible tube, the branch flow passage members 41 can be easily connected to the liquid flow passage ports 15 of the positioned head 10. Moreover, it is not preferable to use a material such as a metal tube which cannot be elastically deformed as the branch flow passage member 41 in that it is difficult to connect the head 10 to the branch flow passage members 41 since the relative positions of the plurality of heads 10 are not completely the same due to a size tolerance of the respective constituent elements in every head unit 1.

The stem flow passage 30 functions as a common flow passage of the plurality of heads 10 and the branch flow passage 40 functions as an individual flow passage provided in each of the liquid passage ports 15 of the head 10. That is, the stem flow passage 30 and the branch flow passage 40 function as an external flow passage connected to the inner flow passage of the head 10 described above. In this embodiment, the stem flow passage 30 and the branch flow passage 40 correspond to a first flow passage for supplying ink to the head 10. That is, a first flow passage member having the first flow passage refers to the stem flow passage member 31 having the stem flow passage 30 and the branch flow passage member 41 having the branch flow passage 40.

In this embodiment, the stem flow passage member 31 described above is supported by a stem flow passage supporting member 50 having a plate shape, as shown in FIG. 5.

The surface of the stem flow passage supporting member 50 having a plate shape is provided with grooves 51 each having a width broader than the outer diameter of the stem flow passage member 31. Two grooves 51 are arranged in the second direction so as to be continuously formed in the first direction. The stem flow passage members 31 provided with the stem flow passages 30 are individually inserted into the grooves 51. Divergent grooves 52 are diverged at the same positions as those of the liquid flow passage ports 15 in the first direction from each of the grooves 51. Parts of the branch flow passage members 41 provided with the branch flow passages 40 are inserted into the divergent grooves 52. Moreover, divergent grooves 52 diverged between the two grooves 51 are each provided with a through-hole (not shown) perforated in the thickness direction. Each of the branch flow passage member 41 is extracted from a side (a side of the rear surface) of the head 10 through the through-hole.

The stem flow passage supporting member 50 is supported on the platform 20 through a plurality of leg portions 53. Each of the leg portions 53 is longer than the height of the head 10 from the platform 20 and a predetermined space is formed between the stem flow passage supporting member 50 supported by the leg portions 53 and the heads 10. The branch flow passage members 41 are disposed in the space between the heads 10 and the stem flow passage supporting member 50. Moreover, branch circuit wirings 61, which are described in detail below, are disposed in the space between the heads 10 and the stem flow passage supporting member 50.

Now, connection between a stem flow passages 30A to 30D of the stem flow passage member 31 and the heads 10 will be described with reference to FIG. 6.

The head 10 is provided with the two nozzle rows 14 and the two liquid passage port 15, as described above. In this embodiment, each of the liquid passage ports 15 communicates with each of the nozzle rows 14.

The stem flow passage 30A is connected to one of the liquid passage ports 15 (a lower side of FIG. 6) of each of the heads 10 constituting the one head group 110.

A stem flow passage 30B is connected to the other of the liquid passage ports 15 (an upper side of FIG. 6) of each of the heads 10 communicating with the stem flow passage 30A.

With such a configuration, ink is supplied from the individual stem flow passages 30A and 30B to the individual nozzle rows 14 of the one head group 110 continuously formed in the first direction.

Likewise, a stem flow passage 30C is connected to one of the liquid passage ports 15 (an upper side of FIG. 6) of each of the heads 10 constituting the other head group 110. A stem flow passage 30D is connected to the other of the liquid passage ports 15 (a lower side of FIG. 6) of each of the heads 10 communicating with the stem flow passage 30C.

With such a configuration, the stem flow passages 30A to 30D individually communicate with four groups of the nozzle rows 14 of the plurality of heads 10 continuously formed in the first direction. In this embodiment, different kinds of ink is supplied to the individual stem flow passages 30A to 30D from a storage unit provided outside the head unit 1.

The connection flow passages 70 communicating with a storage unit 100 storing a liquid are connected to the stem flow passages 30A to 30D via the switching member 80. That is, in this embodiment, the connection flow passages 70 supplying ink to the stem flow passages 30 as the first flow passage are provided as the second flow passage. In this embodiment, a connection flow passage member 71 which has a tubular shape made of metal or resin and has the connection flow passage 70 therein refers to a second flow passage member.

Figure 7:
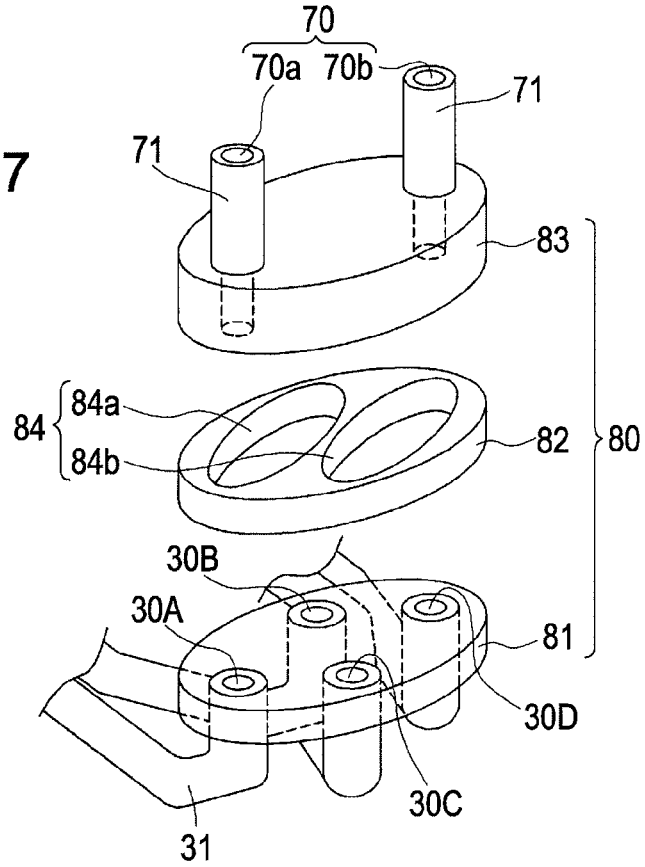
FIG. 7 is an exploded perspective view illustrating a switching member according to the first embodiment of the invention.

Now, the switching member 80 will be described in detail. FIG. 7 is a perspective view illustrating the overall configuration of the switching member.

As shown in FIG. 7, the switching member 80 switches a connection relation between the stem flow passages 30 as the first flow passage and the connection flow passages 70 as the second flow passage. The switching member 80 includes a base 81 to which one ends of the stem flow passage members 31 are fixed, a bush 82 formed on the base 81, and a joint 83 formed on the bush 82.

The base 81 is formed of a plate-shaped member. The one ends of the stem flow passage members 31 in which the step flow passages 30A to 30D are individually formed are fixed to the base 81.

The bush 82 is formed on the base 81 and is provided with switching flow passages 84 perforated through in the thickness direction of the bush 82. The size and the number of switching flow passages 84 are determined such that the switching flow passages 84 independently communicate with the stem flow passages 30A to 30D or commonly communicate with two or more stem flow passages 30A to 30D, that is, the plurality of stem flow passages 30A to 30D. In this embodiment, as the switching flow passages 84, there are provided two switching flow passages: a switching flow passage 84*a* having its size so as to commonly communicate with the stem flow passages 30A and 30B and a switching flow passage 84*b* having its size so as to commonly communicate with the stem flow passages 30C and 30D.

The joint 83 is formed on the bush 82 and is provided with the connection flow passages 70. The connection flow passages 70 communicate with the switching flow passages 84 in the bush 82 and are connected to tube members such as a flexible tube communicating with the storage unit in a side opposite to the bush 82. Accordingly, the joint 83 according to this embodiment is provided with the total two connection flow passages 70*a* and 70*b* in correspondence with the two switching flow passages 84 (84*a* and 84*b*).

In this embodiment, the joint 83 of the switching member 80 is provided with the connection flow passages 70, but the invention is not limited thereto. The connection flow passages may be provided in a member separate from the switching member 80.

In this switching member 80, the connection flow passage 70*a* commonly communicates with the two stem flow passages 30A and 30B via the switching flow passage 84*a*. In addition, the connection flow passage 70*b* commonly communicates with the two stem flow passages 30C and 30D via the switching flow passage 84*b*. That is, ink from the storage unit communicating with the connection flow passage 70*a* is supplied to the two stem flow passages 30A and 30B via the switching flow passage 84*a*. Ink from the storage unit communicating with the connection flow passage 70*b* is supplied to the two stem flow passages 30C and 30D via the switching flow passage 84*b*.

With such a configuration, the same ink is ejected from the two nozzle rows 14 communicating with the stem flow passages 30A and 30B and the same ink is ejected from the two nozzle rows 14 communicating with the stem flow passages 30C and 30D. That is, two different kinds of ink can be ejected from the four groups constituted by the plurality of nozzle rows 14 continuously formed in the first direction in the head unit 1.

Other examples of the switching member 80 are illustrated in FIGS. 8 to 11. FIGS. 8 to 11 are exploded perspective views schematically illustrating a switching member.

Figure 8:
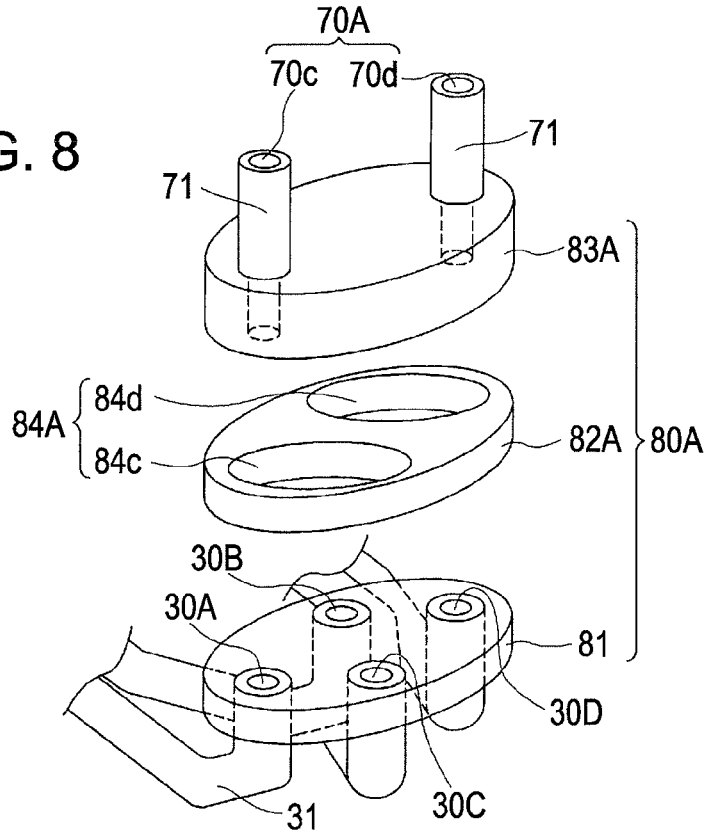
FIG. 8 is an exploded perspective view illustrating a switching member according to the first embodiment of the invention.

As shown in FIG. 8, a switching member 80A includes a base 81, a bush 82A, and a joint 83A.

The bush 82A has a switching flow passage 84A including a switching flow passage 84*c* commonly communicating with the stem flow passages 30A and 30C and a switching flow passage 84*d* commonly communicating with the stem flow passages 30B and 30D.

The joint 83A has a connection flow passage 70A constituted by a connection flow passage 70*c* communicating with the switching flow passage 84*c* and a connection flow passage 70*d* communicating with the switching flow passage 84*d*.

In this switching member 80A, the connection flow passage 70*c* commonly communicates with two stem flow passages 30A and 30C via the switching flow passage 84*c*. In addition, the connection flow passage 70*d* commonly communicates with the two stem flow passages 30B and 30D via the switching flow passage 84*d*. That is, ink from a storage unit communicating with the connection flow passage 70*c* is supplied to the two stem flow passages 30A and 30C via the connection flow passage 70*c* and the switching flow passage 84*c*. In addition, ink from a storage unit communicating with the connection flow passage 70*d* is supplied to the two stem flow passages 30B and 30D via the connection flow passage 70*d* and the switching flow passage 84*d*.

With such a configuration, two different kinds of ink can be ejected from the four groups constituted by the plurality of nozzle rows 14 continuously formed in the first direction in the head unit 1, by a combination different from that of FIG. 7 without changing the configuration of the heads 10 and the configuration of the stem flow passages 30A to 30D, the branch flow passages 40, and the like.

Figure 9:
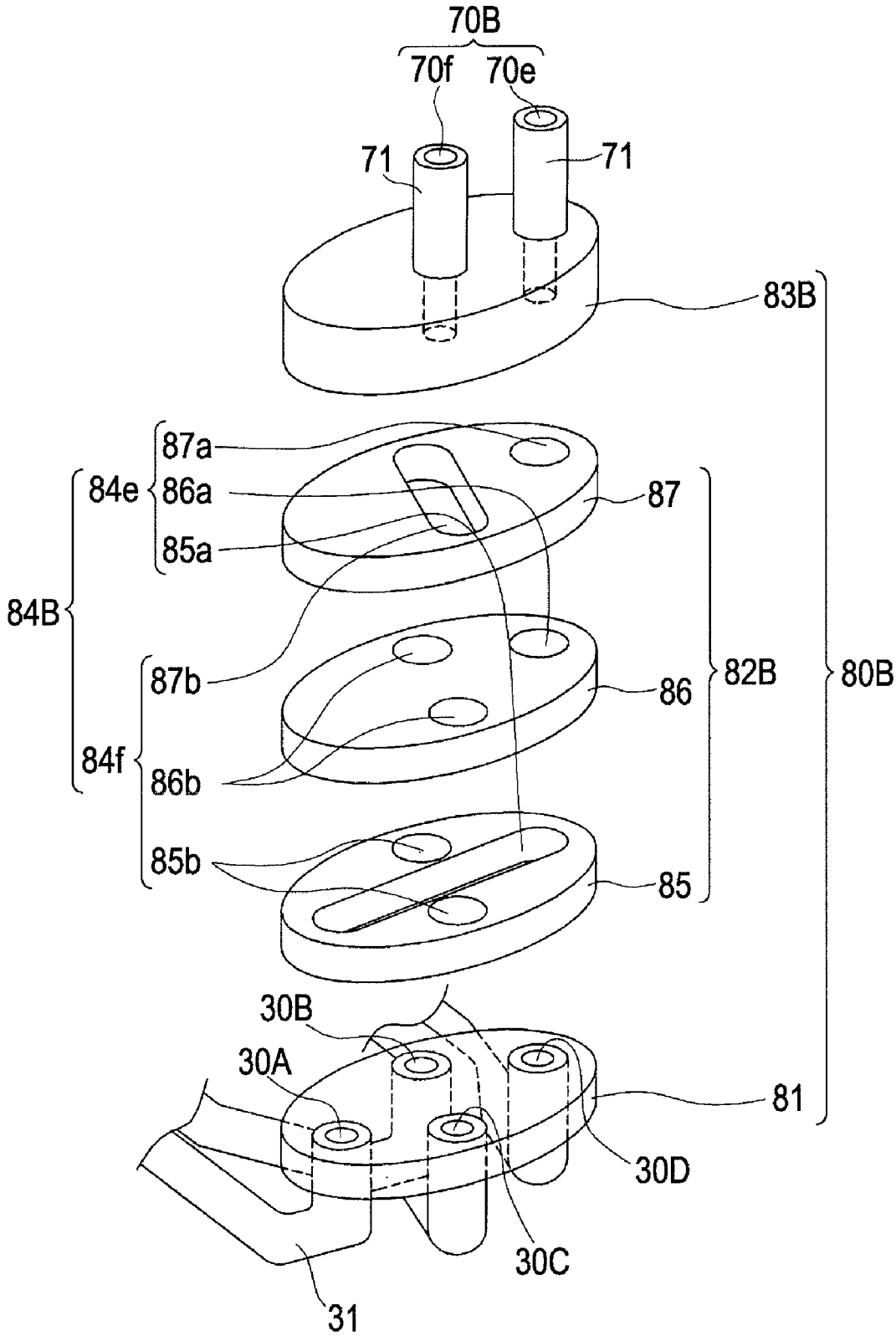
FIG. 9 is an exploded perspective view illustrating a switching member according to the first embodiment of the invention.

As shown in FIG. 9, a switching member 80B includes a base 81, a bush 82B, and a joint 83B.

The bush 82B includes a first bush 85 and an intermediate portion 86, and a second bush 87. The bush 82B is provided with a switching flow passage 84B constituted by two switching flow passages: that is, a switching flow passage 84*e* communicating with stem flow passages 30A and 30D and a switching flow passage 84*f* communicating with stem flow passages 30B and 30C.

Specifically, the first bush 85 close to the base 81 is provided with a first common passage 85*a* perforated in a thickness direction of the first bush 85 and commonly communicating with the stem flow passages 30A and 30D and first independent passages 85*b* perforated in the thickness direction and individually communicating with the stem flow passages 30B and 30C.

The intermediate portion 86 is provided with a first intermediate passage 86*a* perforated in a thickness direction of the intermediate portion 86 and communicating with the first common passage 85*a* of the first bush 85 and second intermediate passages 86*b* perforated in the thickness direction and individually communicating with the two first independent passages 85*b*.

The second bush 87 is provided with a second independent passage 87*a* perforated in a thickness direction of the second bush 87 and communicating with the first intermediate passage 86*a* of the intermediate portion 86 and a second common passage 87*b* perforated in the thickness direction and commonly communicating with the two second intermediate passage 86*b* of the intermediate portion 86.

With such a configuration, the switching flow passage 84*e* commonly communicating with the two stem flow passages 30A and 30D is formed by the first common passage 85*a* of the first bush 85, the first intermediate passage 86*a* of the intermediate portion 86, and the second independent passage 87*a* of the second bush 87.

The switching flow passage 84*f* commonly communicating with the two stem flow passages 30B and 30C is formed by the first independent passages 85*b* of the first bush 85, the two second intermediate passages 86*b* of the intermediate portion 86, and the second common passage 87*b* of the second bush 87.

The joint 83B is provided with a connection flow passage 70B constituted by a connection flow passage 70*e* communicating with the switching flow passage 84*e* of the bush 82B and a connection flow passage 70*f* communicating with the switching flow passage 84*f*.

The connection flow passage 70*e* of the joint 83B commonly communicates with the two stem flow passages 30A and 30D via the switching flow passage 84*e* of the bush 82B. In addition, the connection flow passage 70*f* of the joint 83B commonly communicates with the two stem flow passages 30B and 30C via the switching flow passage 84*f* of the bush 82B.

With such a configuration, ink from a storage unit communicating with the connection flow passage 70*e* is supplied to the two stem flow passages 30A and 30D via the switching flow passage 84*e*. Ink from a storage unit communicating with the connection flow passage 70*f* is supplied to the two stem flow passages 30B and 30C via the switching flow passage 84*f*.

In this way, two different kinds of ink can be ejected from the four groups constituted by the plurality of nozzle rows 14 continuously formed in the first direction in the head unit 1, by a combination different from those of FIGS. 7 and 8 without changing the configuration of the heads 10 and the configuration of the stem flow passages 30A to 30D, the branch flow passages 40, and the like.

Figure 10:
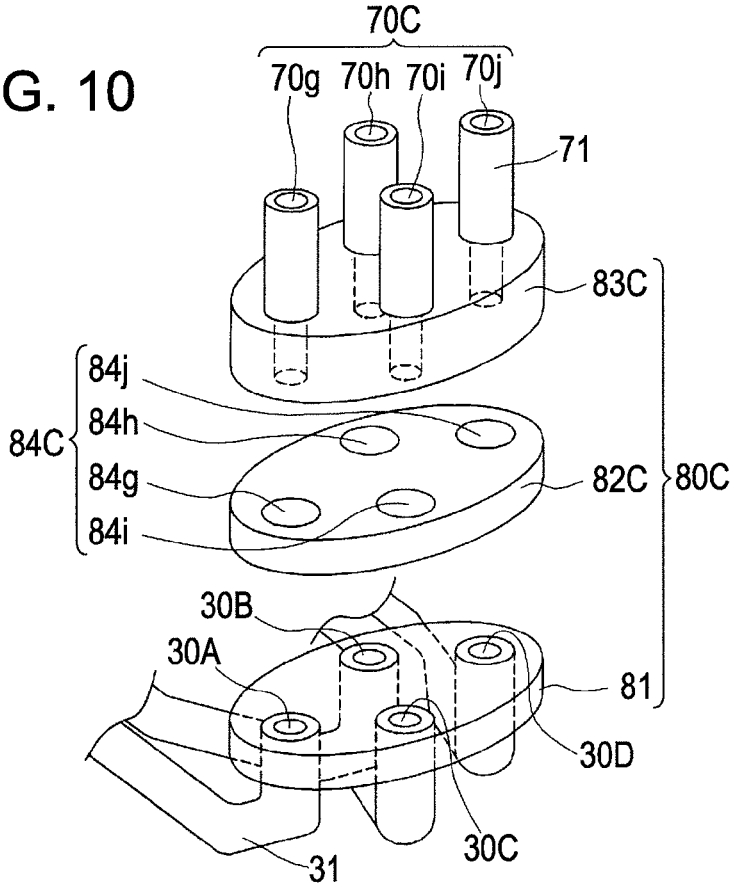
FIG. 10 is an exploded perspective view illustrating a switching member according to the first embodiment of the invention.

As shown in FIG. 10, a switching member 80C includes a base 81, a bush 82C, and a joint 83C.

The bush 82C is provided with a switching flow passage 84C constituted by switching flow passages 84*g*, 84*h*, 84*i*, and 84*j* individually communicating with the stem flow passages 30A and 30D.

The joint 83C is provided with a connection flow passage 70C constituted by connection flow passages 70*g*, 70*h*, 70*i*, and 70*j* individually communicating with the switching flow passages 84*g*, 84*h*, 84*i*, and 84*j*.

In the switching member 80C, different kinds of ink can be ejected from the four nozzle rows 14 individually communicating with the stem flow passages 30A to 30D by individually connecting four storage units storing different kinds of ink to the connection flow passages 70*g* to 70*j*. That is, four different kinds of ink can be ejected from the four groups constituted by the plurality of nozzle rows 14 continuously formed in the first direction in the head unit 1 without changing the configuration of the head 10 and the configuration of the stem flow passages 30A to 30D, the branch flow passages 40, and the like.

Figure 11:
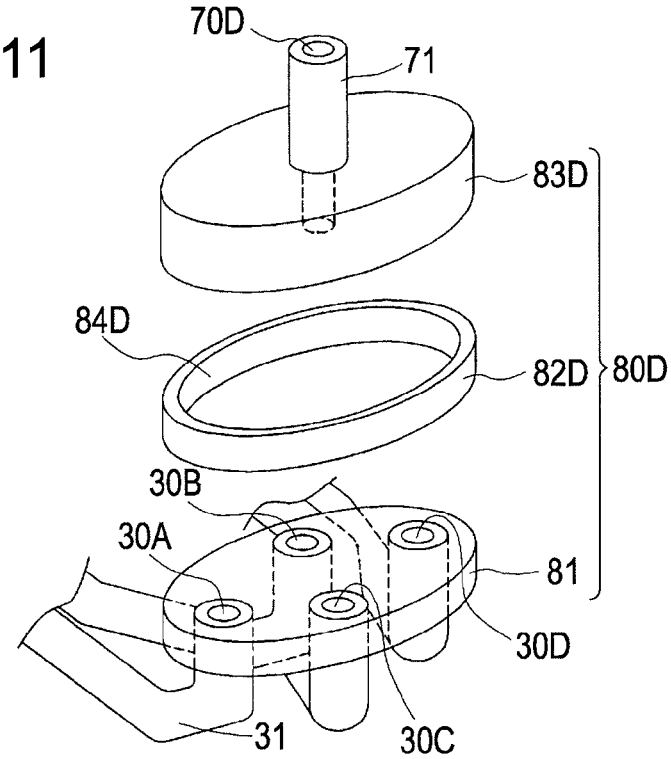
FIG. 11 is an exploded perspective view illustrating a switching member according to the first embodiment of the invention.

As shown in FIG. 11, a switching member 80D includes a base 81, a bush 82D, and a joint 83D.

The bush 82D is provided with a switching flow passage 84D commonly communicating with all the stem flow passages 30A to 30D.

The joint 83D is provided with one connection flow passage 70D communicating with the switching flow passage 84D.

In such a switching member 80D, the same ink can be ejected from the four nozzle rows 14 individually communicating with the stem flow passages 30A to 30D by connecting one storage unit to the one connection flow passage 70D. That is, one kind of ink can be ejected from the four groups constituted by the plurality of nozzle rows 14 continuously formed in the first direction in the head unit 1 without changing the configuration of the head 10 and the configuration of the stem flow passages 30A to 30D, the branch flow passages 40, and the like.

Table 1 shows the combinations of the kinds of ink (the number of groups of the nozzle rows 14 ejecting the same ink) ejected by use of the above-described switching members 80 to 80D and the stem flow passages 30A to 30D used to eject the same ink.

TABLE 1

| KINDS OF INK | SWITCHING MEMBER | COMBINATION OF STEM FLOW PASSAGES 30A TO 30D |
|---|---|---|
| 4 | SWITCHING MEMBER 80C | 30A:30B:30C:30D |
| 2 | SWITCHING MEMBER 80 | 30A + 30B:30C + 30D |
| | SWITCHING MEMBER 80A | 30A + 30C:30B + 30D |
| | SWITCHING MEMBER 80B | 30A + 30D:30B + 30C |
| 1 | SWITCHING MEMBER 80D | 30A + 30B + 30C + 30D |

As described above and shown in Table 1, the head unit 1 according to this embodiment is provided with four stem flow passages 30A to 30D. Therefore, by selectively connecting any one of the switching members 80 to 80D to the stem flow passages 30A to 30D on the basis of the kinds of ink ejected by the four groups of the nozzle rows 14, one kind of ink, two kinds of ink, or four kinds of ink can be ejected from the head unit 1.

When such a head unit 1 is mounted on an ink jet printing apparatus, one of the switching members 80 to 80D is selected in accordance with the number of storage units provided in the ink jet printing apparatus to be connected to the stem flow passages 30A to 30D.

On the other hand, as shown in FIG. 1, the branch circuit board 60 having a plate shape and a wiring pattern (not shown) on the surface thereof is provided on a side close to the stem flow passages 30 and opposite to the platform 20.

An external wiring 90 is connected to one end of the stem circuit board 60 in the first direction. An electric signal such as a print signal or a power source is supplied from the outside to the stem circuit board 60 via the external wiring 90. The external wiring 90 is connected to the end opposite to the connection flow passages 70 to which the storage unit 100 (see FIG. 6) of the stem flow passages 30 is connected and does not interfere with the stem flow passages 31.

The stem circuit board 60 is electrically connected to the connectors 16 of the heads 10 via branch circuit wirings 61 formed of a flexible flat cable (FFC). The electric signal supplied from the external wiring is supplied to the heads 10 via the stem circuit board 60 and the branch circuit wirings 61.

Here, the plurality of branch circuit wirings 61 are connected to the stem circuit board 60 in the first direction in the both ends of the stem circuit board 60 in the second direction. The plurality of branch circuit wirings 61 formed in one end of the stem circuit board 60 in the second direction are connected to the heads 10 of the one head group 110. In addition, the plurality of branch circuit wirings 61 formed in the other end of the stem circuit board 60 are connected to the heads 10 of the other head group 110. That is, in the both ends of the stem circuit board 60 in the second direction, the branch circuit wirings 61 are arranged in the first direction so as to be located at the same positions as those of the connectors 16 of the heads 10 constituting the respective head groups 110. The branch circuit wirings 61 are wound around a rear surface side through side surfaces to which a space between the heads 10 and the stem flow passage supporting member 50 opens from both sides of the stem circuit board 60 in the second direction to be connected to the heads 10.

In this case, as shown in FIGS. 3 and 4, the connectors 16 are arranged at positions different from those of the liquid passage ports 15 in the first direction in one head group 110. Therefore, without interfering with the branch flow passage members 41, the branch circuit wirings 61 can be connected to the heads 10. That is, in one head group 110, the liquid passage ports 15 and the connectors 16 are arranged so as to be visible in the first direction without overlap, when viewed in the second direction. Therefore, the branch flow passage members 41 and the brand circuit wirings 61 connected to the heads 10 do not interfere with each other. Accordingly, without winding the branch circuit wirings 61 in a complex manner, the branch circuit wiring 61 can be easily connected to the head 10 with the short length of the branch circuit wiring 61.

In this way, since the branch flow passage member 41 and the branch circuit wiring 61 can be easily connected to each of the head 10 and the tube and wiring configurations can be simplified, the head unit 1 can be miniaturized. Moreover, erroneous connection can be prevented in an assembly process and assembly time can be shortened to reduce the cost.

The stem circuit board 60 is fixed to the platform 20 through circuit leg portions 63 disposed outside the stem flow passage supporting member 50. The circuit leg portions 63 are formed to have a length longer than the height of the stem flow passage members 31 and a predetermined space is formed between the stem flow passage members 31 and the stem circuit board 60.

In the above-described head unit 1, the heads 10, the platform 20, the stem flow passages 30, the stem circuit board 60, the connection flow passages 70, and the switching member 80 (80A to 80D) are fixed to each other to be modularized (complex components). Accordingly, the head unit 1 can be used just by mounting the modularized head unit 1 on the ink jet printing apparatus, connecting a storage unit such as an ink cartridge or an ink tank to the connection flow passages 70, and connecting the external wiring 90 to the stem circuit board 60.

That is, in the ink jet printing apparatus, the number of storage units storing ink is determined in accordance with the kinds of ink desired to be ejected from the nozzle rows 14 of the head unit 1. Therefore, the head unit 1 can be manufactured by selecting one of the switching members 80 to 80D in which the connection flow passages 70 and the stem flow passages 30 are connected in different connection relations on the basis of the ink desired to be ejected from the nozzle rows 14 of the heads 10, and connecting the selected one of the switching members 80 to 80D to the stem flow passages 30. That is, the switching members 80 to 80D according to this embodiment function as a switching member detachably mounted on the head unit 1 to be replaceable. In this way, since components other than the switching members 80 to 80D in the head unit 1 can be used commonly just by selecting and attaching one of the switching members 80 to 80D, it is not necessary to replace the component other than the switching members 80 to 80D in accordance with the ink desired to be ejected from the nozzle rows 14 of the heads 10. Accordingly, the cost of the head unit 1 can be reduced.

The switching members 80 to 80D of the head unit 1 are just selected and attached. Therefore, the connection flow passages 70 are located at the almost same positions, even when any one of the switching members 80 to 80D is used. Accordingly, it is not necessary to change a process of connecting the storage unit of the ink jet printing apparatus to the connection flow passages in accordance with the positions of the connection flow passages 70 of the head unit 1, for example.

When the head unit 1 is shipped, a user using the head unit 1 can select between the switching members 80 to 80D by packaging and shipping all the plurality of switching members 80 to 80D without providing one of the above-described switching members 80 to 80D. That is, it is not necessary for the user to buy the head unit 1 according to the number of ink desired to be ejected from the head unit 1, the arrangement of ink to be ejected, or the like. The user can select and attach one of the switching members 80 to 80D to the head unit 1 according to the number of ink, the arrangement of ink, or the like.

By fixing the head unit 1 to the main body of the liquid ejecting apparatus so as to align the second direction with a direction in which a printing medium such as a print sheet or a board is transported in the liquid ejecting apparatus such as an ink jet printing apparatus, the head unit 1 according to this embodiment can be applied to a so-called line type printing apparatus in which printing is possible just by transporting the printing medium in the second direction.

The liquid ejecting apparatus is not limited to the line type printing apparatus. For example, by mounting the head unit 1 on a moving unit such as a carriage provided so as to be moved in a direction perpendicular to a transport direction of a printing medium, printing can be performed on a printing medium having a width larger than the length of the nozzle rows 14 continuously formed in the first direction in the head groups 110 of the head unit 1. That is, printing can be performed on a relatively large printing medium by disposing the head unit 1 so as to align the first direction with the transport direction of the printing medium, moving the head unit 1 in the second direction, and printing an image on the printing medium during the movement of the printing medium in the first direction.

Of course, the number of head units 1 mounted on the liquid ejecting apparatus is not particularly limited. A plurality of the head units 1 may be mounted on the liquid ejecting apparatus.

Second Embodiment

Figure 12:
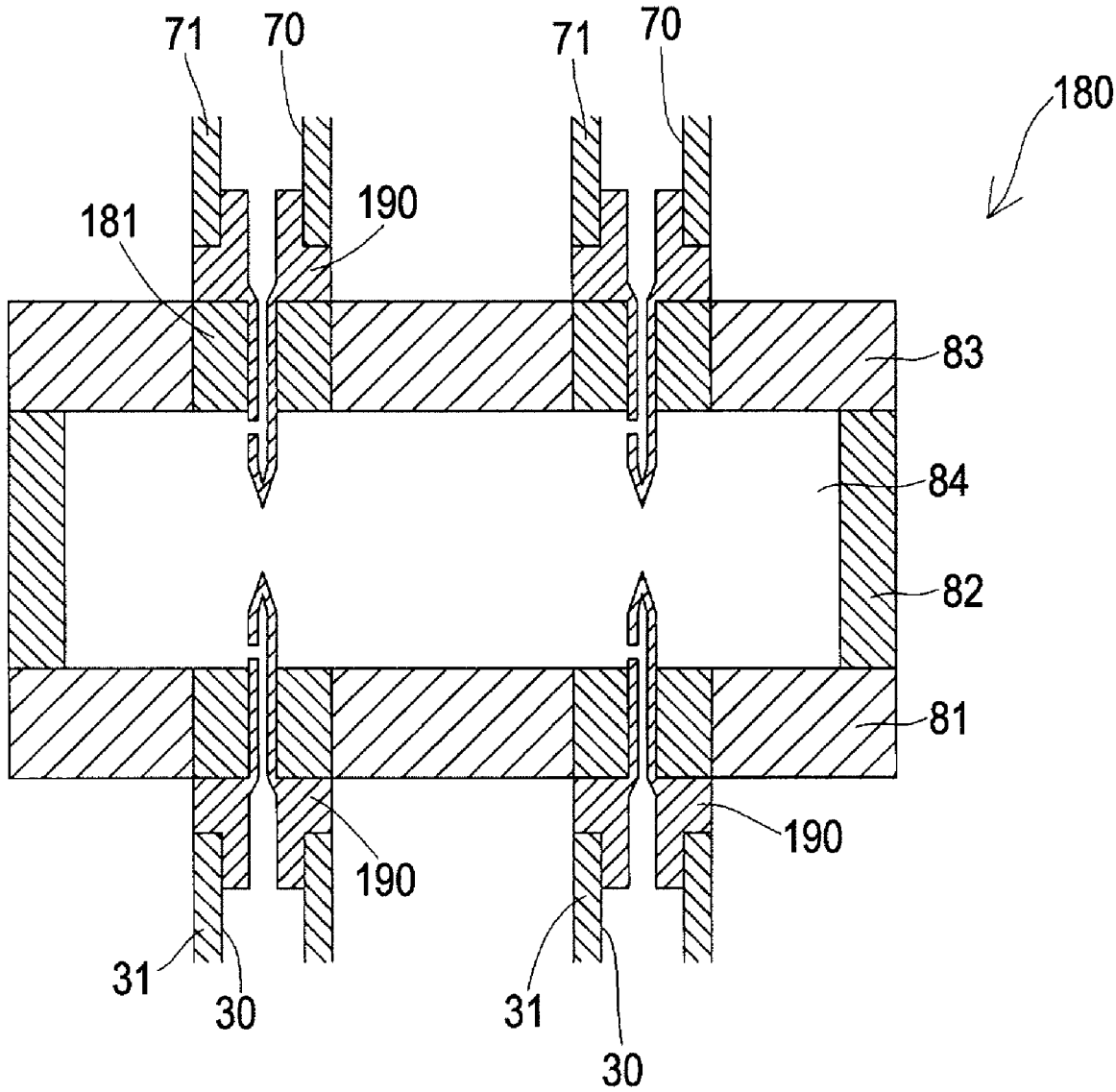
FIG. 12 is a sectional view illustrating a switching member according to a second embodiment of the invention.

FIG. 12 is a sectional view illustrating a switching member according to a second embodiment of the invention. The same constituent elements as those of the above-described first embodiment are given to the same reference numbers and the detailed description is not omitted.

As shown in FIG. 12, a switching member 180 according to this embodiment is provided with elastic members 181 made of an elastic material such as rubber or elastomer in portions connected to the stem flow passages 30 forming the first flow passage and in portions connected to the connection flow passages 70 forming the second flow passage.

On the other hand, individual connection members 190 having a needle-shaped front end are formed in the individual front ends of the connection flow passage member 71 provided with the connection flow passage 70 and the stem flow passage member 31 provided with the stem flow passage 30, and the front ends thereof are connected to the switching member 180. The connection member 190 has a hollow shape. The front end of the connection member 190 has a through shape communicating with the switching flow passage 84 of each switching member 180 and the base end thereof has a through shape communicating with the stem flow passage 30 and the connection flow passage 70.

The connection members 190 communicates with the stem flow passage 30 or the connection flow passage 70 and the switching flow passage 84 by inserting the respective front ends thereof into the elastic members 181 of the switching member 180. When the switching member 180 is replaced, the connection members 190 are extracted from the elastic members 181. At this time, the elastic members 181 are made of the elastic material. Therefore, by extracting the connection members 190 having the needle shape, ink inside the switching member 180 can be prevented from leaking to the outside since the elastic members 181 are elastically deformed to block holes through which the connection members 190 are inserted.

By reducing leakage of the ink inside the switching flow passages 84 to the outside at the time of extracting the stem flow passage members 31 and the connection flow passage members 71 in replacement of the switching member 180, the ink can be prevented from attaching to the heads 10, the connectors 16, the branch circuit wirings 61, and the like. Accordingly, it is possible to prevent an electric failure such as a short circuit or an ink ejection failure from occurring.

Alternatively, in replacement of the switching member 180, the ink inside the connection flow passages 70 or the stem flow passages 30 can be prevented from leaking to the outside by applying pressure from an outside of the connection flow passage members 71 or the stem flow passage members 31 and blocking the connection flow passages 70 and the stem flow passages 30.

This switching member 180 and the connection member 190 are applicable to the switching members 80 to 80D of the above-described first embodiment.

Third Embodiment

Figure 13:
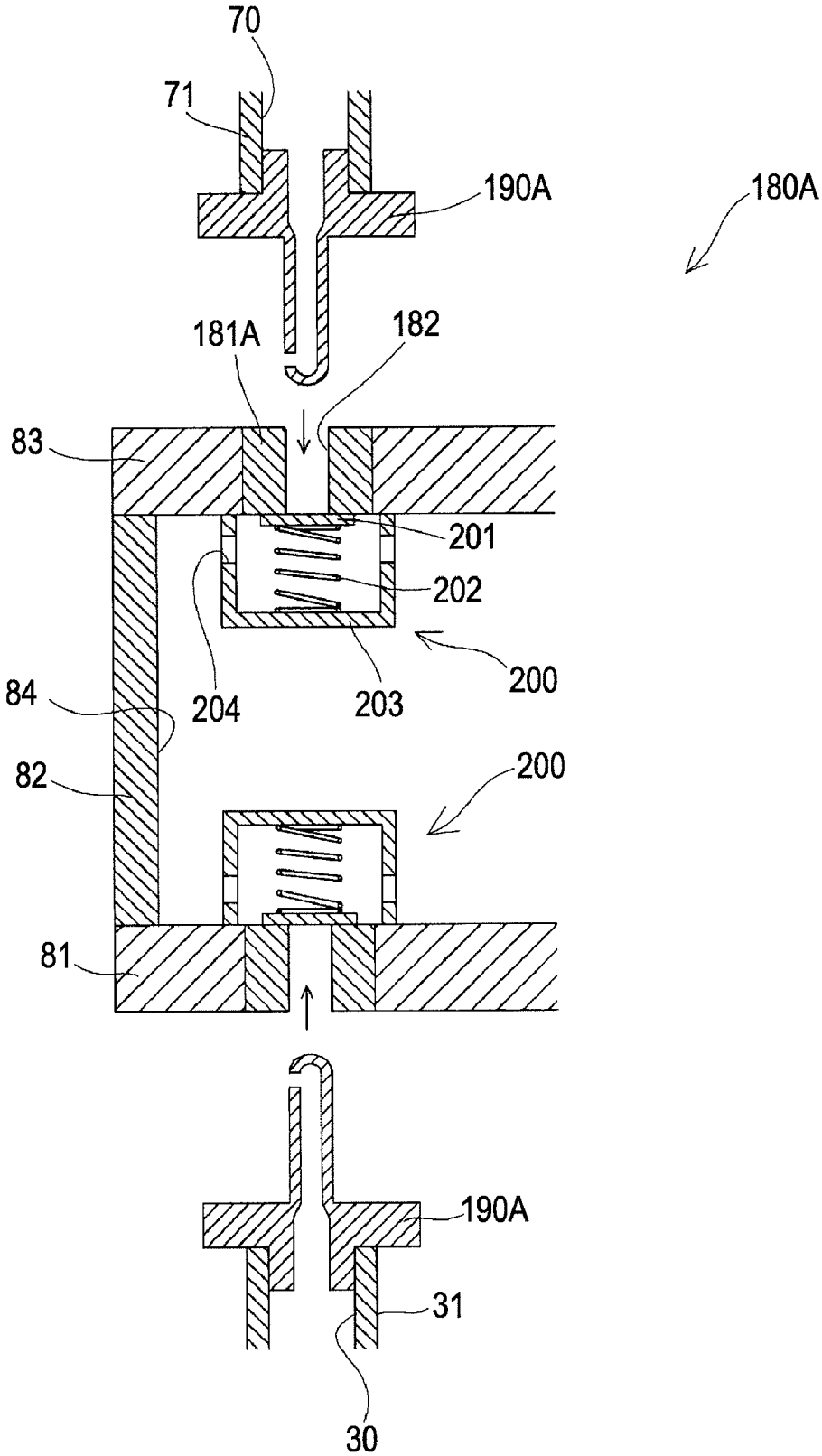
FIG. 13 is a sectional view illustrating main constituent elements of a switching member according to a third embodiment of the invention.
Figure 14:
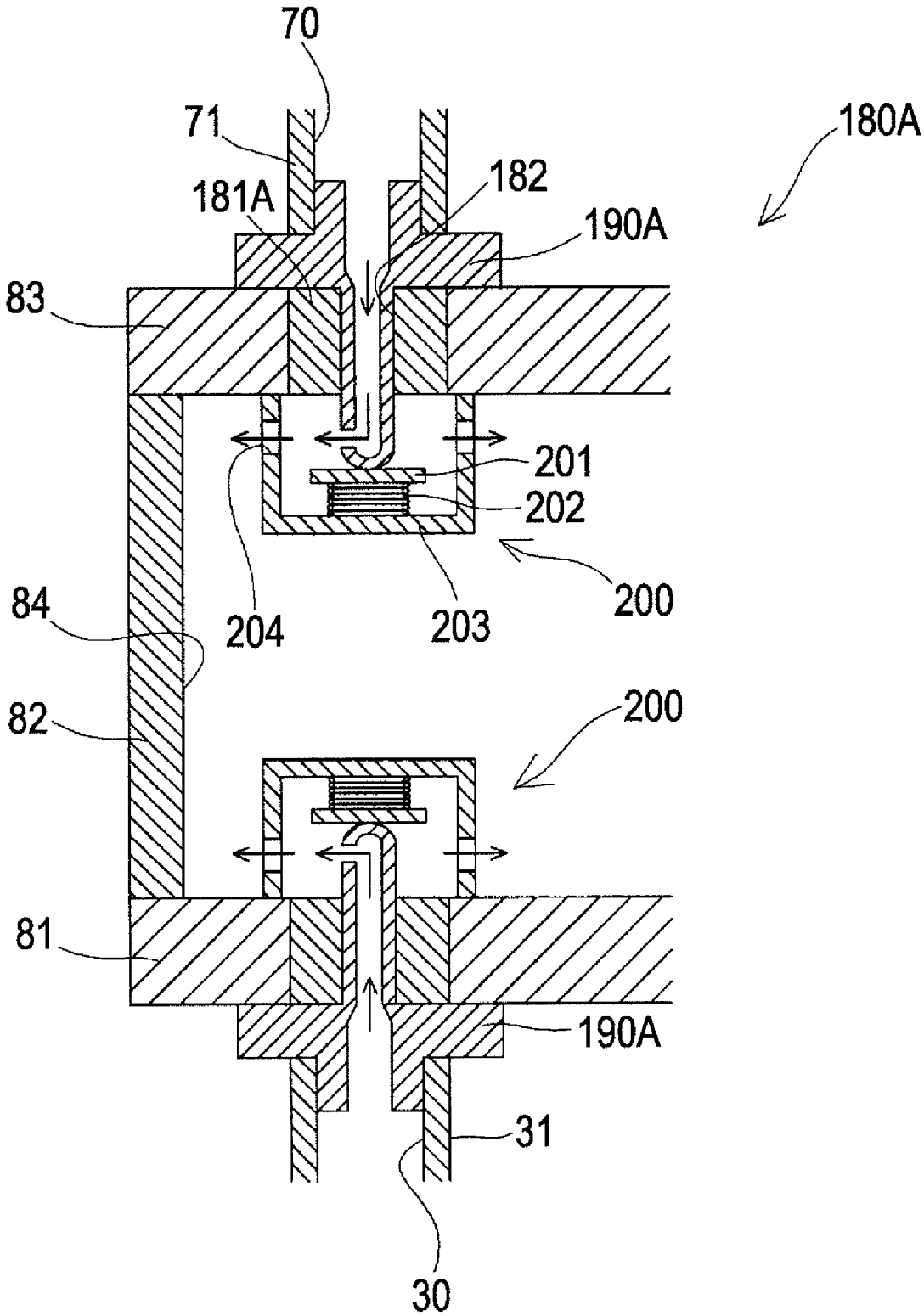
FIG. 14 is a sectional view illustrating the main constituent elements of the switching member according to the third embodiment of the invention.

FIGS. 13 and 14 are sectional views illustrating main constituent elements of a switching member according to a third embodiment of the invention. The same reference numbers are given to the same constituent elements as those of the above-described embodiments and the detailed description is not omitted.

According to this embodiment, as shown in FIGS. 13 and 14, a valve 200 is provided inside the switching flow passage 84 of a switching member 180A.

Specifically, the switching member 180A is provided with insertion holes 182 into which connection members 190A formed in the front ends of the stem flow passage member 31 and the connection flow passage member 71 are inserted. Each of the insertion holes 182 has an inner diameter slightly smaller than the outer diameter of the connection member 190A. By forming elastic member 181A in the circumference of the insertion hole 182, a gap is prevented from occurring between the connection member 190A and the insertion hole 182 and thus ink is prevented from leaking to the outside at the time of inserting the connection member 190A into the insertion hole 182, as shown in FIG. 14.

A valve 200 is provided in each area where the insertion hole 182 inside the switching member 180A opens. The valves 200 are provided in a portion connected to the stem flow passage member 31 as the first flow passage member and a portion connected to the connection flow passage member 71 as the second flow passage member, respectively, so as to be opened by connecting the stem flow passage member 31 to the connection flow passage member 71.

Specifically, each of the valve 200 includes a lid portion 201 having an outer diameter larger than the insertion hole 182, an urging portion 202 urging the lid portion 201 toward the insertion hole 182, and a cylindrical valve main body 203 having the lid portion 201 and the urging portion 202 therein.

The valve main body 203 has the cylindrical shape of which one end is fixed to the inner surface of the switching member 180A provided with the insertion hole 182 and the other end is blocked. A communication hole 204 allowing the switching flow passage 84 to communicate with the inside of the valve main body 203 is formed in the side surface of the valve main body 203. The lid portion 201 and the urging portion 202 are formed inside the valve main body 203.

In this embodiment, the urging portion 202 is formed of a coil spring. One end of the urging portion 202 comes in contact with the end surface of the valve main body 203 opposite to the insertion hole 182 and the other end thereof comes in contact with the lid portion 201. The urging portion 202 urges the lid portion 201 toward the insertion hole 182. With such a configuration, as shown in FIG. 13, the lid portion 201 blocks the insertion hole 182 with predetermined pressure by an urging force of the urging portion 202, when the connection member 190A is not inserted into the insertion hole 182.

On the other hand, as shown in FIG. 14, the lid portion 201 is moved toward to a side opposite to the insertion hole 182, when each of the connection members 190A connected to the stem flow passage member 31 and the connection flow passage member 71 is inserted into the insertion hole 182 against the urging force of the urging portion 202. Accordingly, the stem flow passage 30 or the connection flow passage 70 can communicate with the switching flow passage 84 via an inner flow passage of the connection member 190A and an inner flow passage of the valve main body 203.

In this way, by providing the valves 200 in the switching member 180A, ink inside the switching member 180A can be also prevented from leaking to the outside at the time of extracting the stem flow passage members 31 and the connection flow passage members 71 in replacement of the switching member 180A. Therefore, the ink can be prevented from attaching to the heads 10, the connectors 16, the branch circuit wirings 61, and the like. Accordingly, it is possible to prevent the electric failure such as a short circuit or the ink ejection failure from occurring.

Alternatively, in replacement of the switching member 180A, the ink inside the connection flow passages 70 or the stem flow passages 30 can be prevented from leaking to the outside by applying pressure from an outside of the connection flow passage members 71 or the stem flow passage members 31 and blocking the connection flow passages 70 and the stem flow passages 30.

The outer diameter of the connection member 190A according to this embodiment is larger than the outer diameter of the connection member 190 according to the above-described second embodiment. Therefore, even when the connection member 190A is extracted from the insertion hole 182, the insertion hole 182 is not clogged due to the elastic force of the elastic member 181A. However, by using the same connection member 190A and the elastic member 181A as those of the above-described second embodiment, the ink inside the switching member 180A can additionally be prevented from leaking.

Of course, the switching member 180A and the connection member 190A according to this embodiment are applicable to the switching members 80 to 80D of the above-described first embodiment.

Fourth Embodiment

Figure 15:
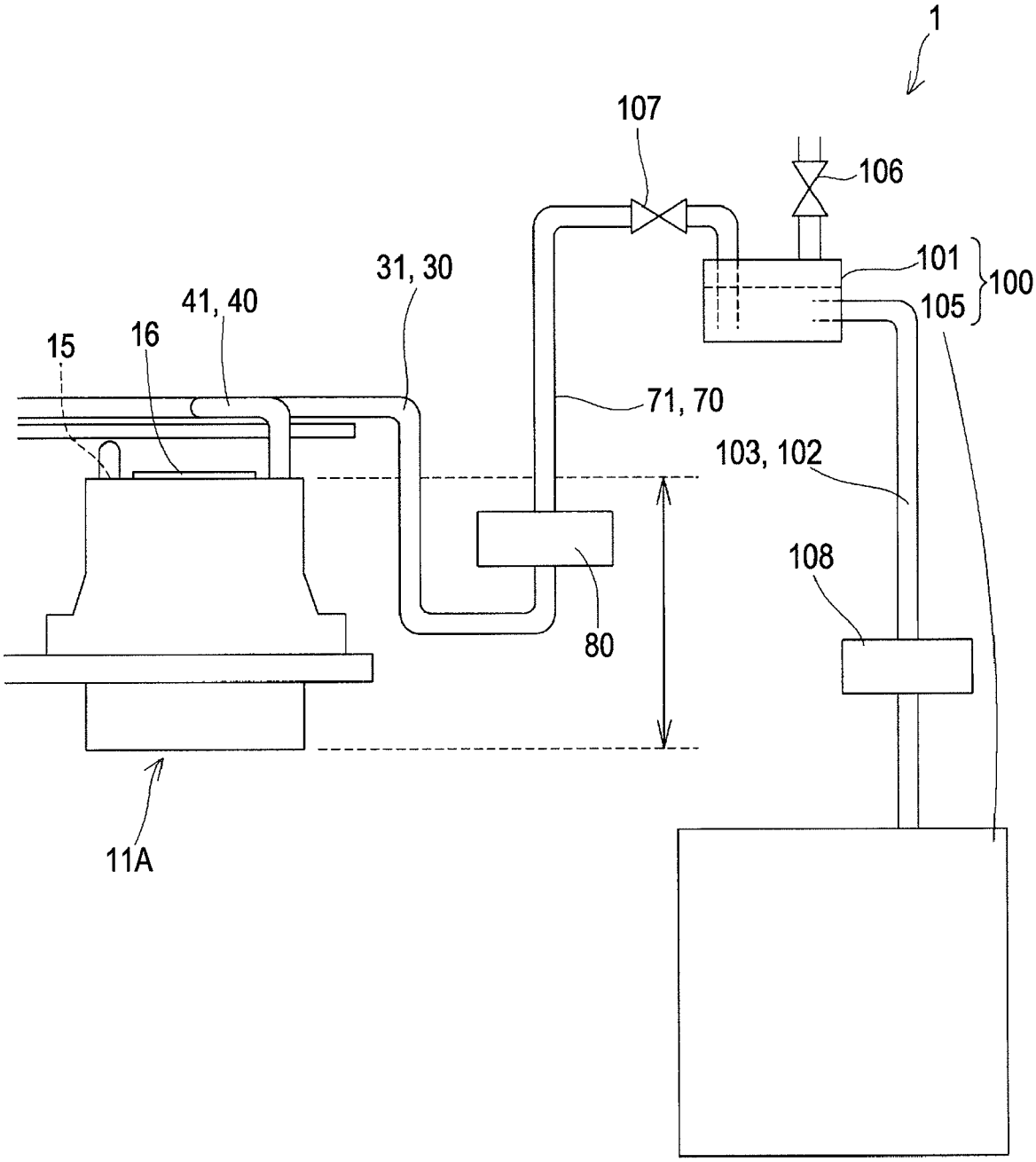
FIG. 15 is a side view illustrating a head unit according to a fourth embodiment of the invention.

FIG. 15 is a side view illustrating the overall configuration of an ink jet print head unit which is an example of a liquid ejecting head unit according to a fourth embodiment of the invention. The same reference numerals are given to the same constituent elements as those of the above-described embodiments and the detailed description is omitted.

As shown in FIG. 15, a switching member 80 according to this embodiment includes the same constituent elements as those of the above-described first embodiment. The switching member 80 is disposed so as to be located in a vertical direction above the nozzle openings (a liquid ejecting surface 11A on which the nozzle openings open) of the head 10 and located in vertical direction below the connector 16 as a connection portion connected to the branch circuit wiring 61 as an electric wiring of the head 10.

The storing unit 100 is connected to the connection flow passage 70 supplying ink to the switching member 80. The storage unit 100 according to this embodiment includes a first storage unit 101 connected to the connection flow passage 70 and disposed above the switching member 80 in the vertical direction and a second storage unit 105 connected to the first storage unit 101 via a supply flow passage member 103 having a supply flow passage 102 and disposed below the switching member 80 in the vertical direction.

Ink stored in the first storage unit 101 is supplied to the switching member 80 via the connection flow passage 70 using a siphon principle. The first storage unit 101 is provided with an air introducing valve 106 introducing the inner portion storing the ink to the air and a switching valve 107 connecting or blocking the first storage unit 101 and the connection flow passage 70.

On the other hand, the second storage unit 105 stores ink and supplies ink to the first storage unit 101 via the supply flow passage 102. Moreover, the second storage unit 105 supplies ink to the first storage unit 101 disposed above the second storage unit 105 in the vertical direction by a pump 108 provided in the midway of the supply flow passage member 103.

With such a configuration, the ink is supplied from the second storage unit 105 to the first storage unit 101 via the supply flow passage 102 by the pump 108. The ink supplied to the first storage unit 101 is supplied to the switching member 80 via the connection flow passage member 71 having the connection flow passage 70 as a siphon tube.

In the head 10 according to this embodiment, the liquid flow passage ports 15 to which the stem flow passage 30 is connected via the branch flow passage 40 are disposed so as to have the same height of as that of the connector 16. However, since the first storage unit 101 is disposed above the switching member 80 and the liquid flow passage ports 15 in the vertical direction, the ink from the first storage unit 101 is supplied to the liquid flow passage ports 15 of the head 10 via the switching member 80 by the siphon principle.

Even when the stem flow passage member 31 or the connection flow passage member 71 is removed from the switching member 80 in replacement of the switching member 80, it is possible to reduce leaked ink which is attached to the head 10 through the outer circumference of the stem flow passage member 31, particularly attached to the connector 16. That is, when the switching member 80 is disposed above the connector 16 of the head 10 in the vertical direction, the ink leaked to the outside directly may drop to be attached to the connector 16 or may be attached to the connector 16 through the outer circumference of the stem flow passage member 31 in replacement of the switching member 80. However, by disposing the switching member 80 below the connector 16 in the vertical direction, the ink leaked to the outside can be prevented from being attached to the connector 16. Accordingly, it is possible to prevent an electric short circuit caused to the attached ink.

When the connection flow passage member 71 is removed from the switching member 80, the ink can be prevented from leaking from the connection flow passage 70 by closing the connection flow passage 70 by the switching valve 107. Moreover, when the stem flow passage member 31 is removed from the switching member 80, bubbles can be prevented from penetrating from the nozzle openings to the inside of the head 10 since the switching member 80 is disposed above the nozzle openings (the liquid ejecting surface 11A on which the nozzle openings open) in the vertical direction. In this case, it is preferable to suppress a water head difference occurring between the nozzle openings 11 and the switching member 80 to the extent of restraining ink from leaking from the nozzle openings 11 and bubbles penetrate from the stem flow passage member 31 by a surface tension of the ink in the nozzle openings 11.

Moreover, it is preferable to maintain the meniscus of the nozzle openings 11 constantly in a printing process. The maintenance of the meniscus of the nozzle openings 11 constantly can be realized by providing a self sealing valve in the head 10 and maintaining the inside of the head 10 with pressure of a certain range. Alternatively, the maintenance may be realized by providing a pressure controller in the first storage unit 101 and controlling the pressure inside the head 10 so as to be maintained in a certain range.

By the switching members 180 and 180A according to the above-described second and third embodiments as the switching member 80 used in the head unit 1, the ink can be prevented from leaking in replacement of the switching members 180 and 180A. Moreover, even when the ink is leaked to the outside, the leaked ink can be prevented from being attached to the connector 16 of the head 10 or the like. Accordingly, it is possible to improve reliability.

Other Embodiments

The embodiments of the invention have been described, but the basic configuration of the invention is not limited to the above-described embodiments. The above-described embodiments may be combined or other modifications may be made.

For example, in the above-described embodiments, the four stem flow passages 30 are provided. However, the number of stem flow passages 30, the arrangement of the heads 10 connected to one stem flow passage 30, or the like is not particularly limited to the above description. That is, the number of stem flow passages is not particularly limited, as long as two or more stem flow passages are provided in the head unit 1. Moreover, the stem flow passages may be arranged so as to communicate with the liquid flow passage ports 15 of the heads 10 arranged in the second direction. Alternatively, the stem flow passages may be arranged so as to communicate with the liquid flow passage ports 15 of the heads 10 arranged in the first and second directions.

Figure 16:
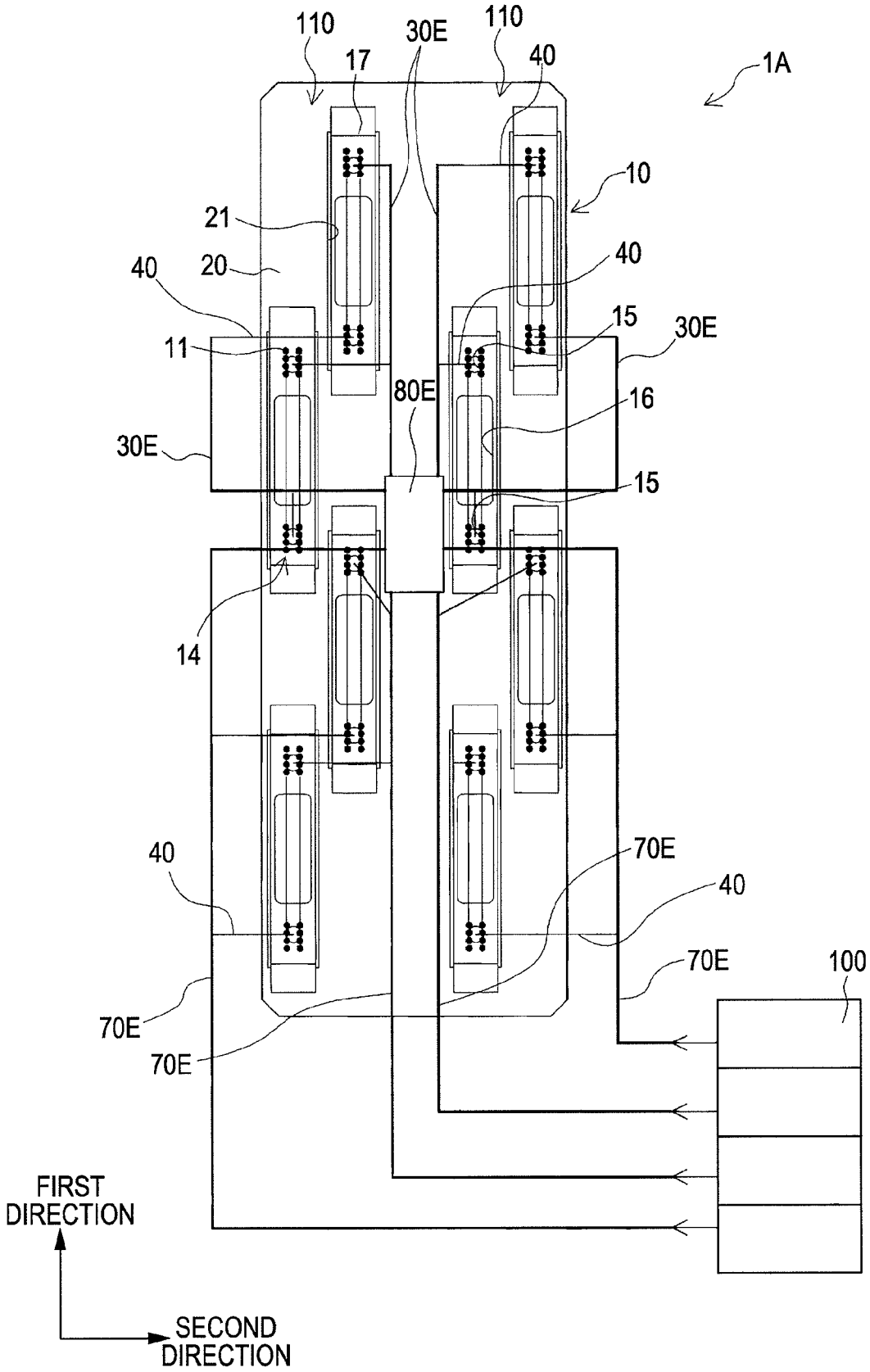
FIG. 16 is a schematic plan view illustrating connection of flow passages according to another embodiment of the invention.

In the above-described embodiment, the heads 10 are not connected to the connection flow passages 70 to 70D, but the heads 10 may be directly connected to the connection flow passages. FIG. 15 shows an example of the direct connection. FIG. 16 is a schematic plan view illustrating connection between the connection flow passages and the stem flow passages.

As shown in FIG. 16, a head unit 1A is provided with four stem flow passages 30E and four connection flow passages 70E. The liquid passage ports 15 of the plurality of heads 10 are connected to the midway of the connection flow passages 70E communicating with the storage unit 100 via the branch flow passages 40. In addition, the liquid passage ports 15 of the plurality of heads 10 are connected to the stem flow passages 30E via the branch flow passages 40. A switching member 80E switching communication between the stem flow passages 30E and the connection flow passages 70E is provided between the stem flow passages 30E and the connection flow passages 70E.

Like the above-described switching members 80 to 80D, a plurality of the switching members 80E are prepared in the head unit 1A having such a configuration. Then, by selecting and attaching the plurality of switching members 80E on the basis of kinds of ink ejected from the nozzle rows 14 of the heads 10, the kinds of ink ejected from the nozzle rows 14 of the heads 10 can be easily changed. That is, one connection flow passage 70E may be connected to one of the four stem flow passages 30E, one connection flow passage 70E may be connected to two stem flow passages 30E, two connection flow passages 70E may be connected to one stem flow passage 30E, three connection flow passages 70E may be connected to one stem flow passage 30E. Of course, besides the above-described configuration, the connection flow passages 70E and the stem flow passages 30E may satisfy a condition of the number of connection flow passages 70E: the number of stem flow passages 30E=m:n (where $0<m\leqq 4$, $0<n\leqq 4$). In this way, by connecting the heads 10 to the connection flow passages 70E on an upstream side of the switching member 80E and substantially disposing the switching member 80E to the midway of the stem flow passages 30, the kinds of ink ejected in the first direction can be changed in the nozzle rows 14 arranged in the first direction in the head unit 1A having the configuration shown in FIG. 16, that is, in one group constituted by the plurality of nozzle rows 14 continuously formed in the first direction according to this embodiment. Of course, the switching members 80 to 80D of the above-described first embodiment and the switching member 80E shown in FIG. 16 may be provided together.

In the examples described above, the switching members 80 to 80E, 180, and 180A are provided in the head units 1 and 1A, respectively, so as to be detachably mounted in the stem flow passages 30. However, the invention is not particularly limited thereto. For example, a switching member including a switching valve capable of changing a plurality of flow passages may be provided in the head units 1 and 1A.

In the above-described embodiments, the two nozzle rows 14 are provided in each of the heads 10, but the invention is not particularly limited thereto. For example, one nozzle row 14 may be provided in each of the heads 10 or three or more nozzle rows may be provided in each of the heads 10.

In the above-described embodiments, the four heads 10 constitute the head group 110, but the invention is not particularly limited thereto. For example, two or more heads 10 may constitute the head group 110.

In the above-described embodiments, the two head groups 110 are provided in the head unit 1, but the invention is not particularly limited thereto. For example, one head group 110 may be provided or three or more head groups 110 may be provided.

In the above-described embodiments, the liquid passage ports 15 and the connector 16 are provided on the rear end surface opposite to the nozzle openings 11 of each head 10, but the invention is not particularly to limited thereto. For example, one or both of the liquid passage ports 15 or the connector 16 may be provided on a side surface of each head 10.

For example, like the above-described embodiments, two liquid passage ports 15 are provided in one head 10. In this case, when one of the liquid passage ports 15 is configured as a liquid supply port supplying ink (liquid) to the head 10 and the other of the liquid passage ports 15 is configured as a liquid discharge port discharging ink (liquid) from the head 10, the liquid passage ports 15 of the plurality of heads 10 close in the first direction may be configured as the liquid supply port or the liquid discharge port, for example, as shown in FIG. 4. That is, by arranging the liquid supply port and the liquid discharge port so as to be close in the first direction, supply characteristics and discharge characteristics of ink from the external storage unit to the plurality of heads 10 close in the first direction can be made uniform, and thus liquid ejection characteristics can be made uniform.

What is claimed is:

1. A liquid ejecting head unit provided with a plurality of liquid ejecting heads which each have a nozzle row in which a plurality of nozzle openings are arranged and a liquid passage port to which an inner flow passage opens and an outer flow passage is connected, the liquid ejecting head unit comprising:

first flow passage members which are each provided with a first flow passage supplying a liquid to the liquid passage port of each of the plurality of liquid ejecting heads;

second flow passage members which are each provided with a second flow passage supplying the liquid to the first flow passage; and a switching member which is provided between the first and second flow passages and allows the first flow passages to communicate with the second flow passages in a predetermined communication relation, wherein the switching member has a shape corresponding to the communication relation and the communication between the first flow passages and the second flow passages is changed by replacing the switching member by a switching member having a different shape.

2. The liquid ejecting head unit according to claim 1, wherein the switching member has valves which open by connecting the first flow passage members in portions thereof to which the first flow passage members are connected.

3. The liquid ejecting head unit according to claim 1, wherein the switching member has valves which open by connecting the second flow passage members in portions thereof to which the second flow passage members are connected.

4. The liquid ejecting head unit according to claim 1, wherein the liquid ejecting head has a connection portion which is connected to an electric wiring and located above the nozzle openings in a vertical direction; and wherein the switching member is located above the nozzle openings in the vertical direction and below the connection portion in the vertical direction.

5. A method of manufacturing a liquid ejecting head unit provided with a plurality of liquid ejecting heads which each have a nozzle row in which a plurality of nozzle openings are arranged, a plurality of liquid passage ports to which an inner flow passage opens and an outer flow passage is connected, first flow passage members which are each provided with a first flow passage supplying a liquid to the liquid passage ports of each of the plurality of liquid ejecting heads, and second flow passage members which are each provided with a second flow passage supplying the liquid to the first flow passage, the method comprising:

selecting one of a plurality of switching members of which communication relations between the first flow passages and the second flow passages are different from each other, on the basis of kinds of liquids ejected from the nozzle rows of the liquid ejecting heads; and allowing the first flow passages to communicate with the second flow passages in a predetermined communication relation by connecting the first and second flow passage members to the selected switching member.

* * * * *